US006656653B2

(12) United States Patent
Mitsuhashi et al.

(10) Patent No.: US 6,656,653 B2
(45) **Date of Patent: *Dec. 2, 2003**

(54) TONER FOR THE DEVELOPMENT OF ELECTROSTATIC IMAGE AND METHOD FOR PRODUCING THE SAME

(75) Inventors: Kazuo Mitsuhashi, Kanagawa (JP); Osamu Ando, Kanagawa (JP); Noriaki Takahashi, Tokyo (JP); Tomoko Ishikawa, Kanagawa (JP); Yuqing Xu, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/736,150

(22) Filed: Dec. 15, 2000

(65) Prior Publication Data

US 2002/0042012 A1 Apr. 11, 2002

(30) Foreign Application Priority Data

| | | |
|---|---|---|
| Dec. 15, 1999 | (JP) | 11-355371 |
| Mar. 7, 2000 | (JP) | 2000-061698 |
| Mar. 7, 2000 | (JP) | 2000-061699 |
| Jun. 19, 2000 | (JP) | 2000-182606 |

(51) Int. Cl.[7] ..... G03G 9/087; G03G 9/09; G03G 9/097

(52) U.S. Cl. ..... 430/108.23; 430/108.1; 430/108.4; 430/109.3; 430/110.2; 430/110.3; 430/110.4; 430/111.4; 430/137.11; 430/137.14; 430/137.17

(58) Field of Search ..... 430/109.3, 110.1, 430/110.2, 110.3, 110.4, 108.4, 108.23, 111.4, 137.14, 137.17, 137.11, 137.19, 108.11, 108.1

(56) References Cited

U.S. PATENT DOCUMENTS

| | | | | | |
|---|---|---|---|---|---|
| 5,213,932 | A | * | 5/1993 | Shimazaki | 430/108.23 |
| 5,328,791 | A | * | 7/1994 | Ohta | 430/110.4 |
| 5,445,910 | A | * | 8/1995 | Ishikawa et al. | 430/108.11 |
| 5,635,325 | A | | 6/1997 | Inaba et al. | |
| 5,741,617 | A | * | 4/1998 | Inaba et al. | 430/111.4 |
| 5,750,303 | A | * | 5/1998 | Inaba et al. | 430/111.4 |
| 5,935,751 | A | * | 8/1999 | Matsuoka et al. | 430/137.17 |
| 5,948,584 | A | * | 9/1999 | Hashimoto et al. | 430/124 |
| 5,976,755 | A | * | 11/1999 | Yoshida et al. | 430/110.3 |
| 6,030,739 | A | | 2/2000 | Ishikawa et al. | |
| 6,074,794 | A | * | 6/2000 | Fushimi et al. | |
| 6,077,635 | A | * | 6/2000 | Okado et al. | 430/111.4 |
| 6,132,921 | A | * | 10/2000 | Ishiyama et al. | 430/137.14 |
| 6,190,819 | B1 | | 2/2001 | Takahashi et al. | |
| 2001/0033982 | A1 | * | 10/2001 | Ishikawa et al. | 430/110.1 |

FOREIGN PATENT DOCUMENTS

| | | | | |
|---|---|---|---|---|
| JP | 59-165069 | * | 9/1984 | 430/108.23 |
| JP | 8-50368 | | 2/1996 | |
| JP | 9-190012 | | 7/1997 | |
| JP | 10-301332 | | 11/1998 | |

OTHER PUBLICATIONS

Derwent Abstract 84–272064/44 (attached to JP 59–165069), 1984.*

Diamond, A.S. ed, Handbook of Imaging Materials, Marcel Dekker, NY (1991), pp. 165–168.*

USPTO English–Language Translation of JP 59–165069 (Pub Sep. 1984).*

* cited by examiner

*Primary Examiner*—Janis L. Dote
(74) *Attorney, Agent, or Firm*—Oblon, Spivak, McClelland, Maier & Neustadt, P.C.

(57) ABSTRACT

A toner is provided for the development of an electrostatic image which includes an agglomerate of particles obtained by agglomerating at least primary polymer particles and primary colorant particles, wherein the toner has a THF insoluble content of from 15% to 80% and the toner further includes a wax having a melting point of 30 to 100° C., and the method for producing the same.

119 Claims, No Drawings

TONER FOR THE DEVELOPMENT OF ELECTROSTATIC IMAGE AND METHOD FOR PRODUCING THE SAME

FIELD OF THE INVENTION

The present invention relates to a toner for the development of an electrostatic image, particularly for use in electrophotographic process copying machines and printers. More particularly, the present invention relates to a toner for the development of an electrostatic image prepared by emulsion polymerization agglomeration method.

BACKGROUND OF THE INVENTION

A conventional toner for the development of an electrostatic image which has previously been widely used in electrophotography has been prepared by a process which comprises melt-kneading a mixture of a binder resin such as of a syrene-acrylate copolymer, or polyester, a colorant such as carbon black and a pigment, a charge control agent and/or a magnetic material through an extruder, grinding the material obtained, and then classifying the resulting powder. However, the conventional toner obtained by such a melt-kneading/grinding process has the disadvantage that the controllability of the particle diameter of the toner is limited, making it difficult to prepare a toner substantially having an average particle diameter of not more than 10 $\mu$m, particularly not more than 8 $\mu$m in a good yield. Thus, the conventional toner cannot be considered good enough to provide the high resolution that will be required in the future electrophotography.

In order to achieve oilless low temperature fixability, an approach involving the blend of a low softening wax in a toner during kneading has been proposed. In the kneading/crushing process, however, the amount of wax to be blended is limited to about 5% by weight. Thus, toners having sufficient low temperature fixability and OHP transparency cannot be obtained.

In an attempt to overcome difficulty in controlling the particle diameter and hence realize high resolution, JP-A-63-186253 (The term "JP-A" as used herein means an "unexamined published Japanese patent application") proposes a process for the preparation of a toner involving emulsion polymerization/agglomeration process. However, this process is also limited in the amount of wax that can be effectively introduced into the agglomeration step. Thus, this process leaves something to be desired in the improvement in oilless low temperature fixability.

JP-A-9-190012 proposes a process for the preparation of a toner involving emulsion polymerization/agglomeration process using crosslinked primary polymer particles for suppressing gloss in a formed image. However, this process provides an image with insufficient OHP transparency.

In JP-A-8-50368, a toner is disclosed containing a low melting point ester-based wax. Specifically, however, the toner described in this publication is produced by suspension polymerization. The particle size distribution of the toner is difficult to control due to the production process. Thus, it is difficult to obtain a high resolution image with this toner. In JP-A-10-301322 a toner is disclosed containing a low melting point ester-based wax produced by an emulsion polymerization agglomeration process. The toner described in this publication, however, comprises an uncrosslinked binder resin. Further, OHP transparency and offset resistance of the toner are not sufficient.

SUMMARY OF THE INVENTION

It is therefore an object of the present invention to overcome the difficulties of the conventional toner for the development of an electrostatic image.

It is a further object of the present invention to provide a toner having high resolution, oilless fixability, and sufficient low temperature fixability, offset resistance, blocking resistance, fixing temperature width and OHP transparency.

It is a further object of the present invention to provide a process for producing such a toner. These and other objects of the present invention have been satisfied by the discovery of an emulsion polymerization agglomeration toner comprising a low melting point wax and using primary polymer particles and/or particulate resin having a specified crosslinking degree, and the process for producing the same.

DETAILED DESCRIPTION OF THE PREFERRED EMBODIMENTS

The present invention relates to a toner or the development of an electrostatic image comprising an agglomerate of particles obtained by agglomerating a mixture comprising (i.e. at least) primary polymer particles and primary colorant particles, wherein an insoluble content in tetrahydrofuran (the THF insoluble content) of the toner is from 15% to 80 w/w (all percentages are w/w % unless otherwise indicated) and the toner comprises wax having a melting point of 30 to 100° C.

The present invention further relates to a toner for the development of an electrostatic image comprising an agglomerate of particles obtained by agglomerating at least primary polymer particles and primary colorant particles, wherein the THF insoluble content of the primary polymer particles is from 15% to 70 w/w % and the toner comprises wax having a melting point of 30 to 100° C.

A further embodiment of the present invention relates to a toner for the development of an electrostatic image comprising an agglomerate of particles obtained by agglomerating at least primary polymer particles and primary colorant particles, wherein a proportion of a polyfunctional monomer in monomer components constituting the primary polymer particles is 0.005 to 5 w/w % and the toner comprises wax having a melting point of 30 to 100° C.

An additional embodiment of the present invention relates to a method for producing a toner for the development of an electrostatic image comprising agglomerating at least primary polymer particles and primary colorant particles to form an agglomerate of particles, wherein the primary polymer particles are produced by emulsion polymerization of a monomer mixture comprising 0.005 to 5 w/w % of a polyfunctional monomer, and the toner comprises wax having a melting point of 30 to 100° C.

The toner according to the present invention comprises wax, primary polymer particles and primary colorant particles, and, if necessary, comprises one or more of a charge control agent, particulate resin and other additives. The toner of the present invention is produced by an emulsion polymerization agglomeration method. According to the emulsion polymerization agglomeration method, the toner is produced by co-agglomerating at least primary polymer particles obtained by emulsion polymerization, and primary colorant particles and, depending upon necessity, primary charge control agent particles and particulate resin.

Further, in the toner of the present invention the resin constituting primary polymer particles and/or particulate resin is preferably crosslinked and a low melting point wax is preferably included in the toner.

Wax

The wax used in the present invention, can be any conventional wax having a melting point of 30 to 100° C.

Examples of such waxes include olefinic waxes such as low molecular weight polyethylene, low molecular weight polypropylene and polyethylene copolymer; paraffin waxes; ester-based waxes having a long-chain aliphatic group such as behenyl behenate, montanic acid ester and stearyl stearate; vegetable waxes such as hydrogenated castor oil and carnauba wax; ketones having a long-chain alkyl group such as distearyl ketone; silicones having an alkyl group; higher aliphatic acids such as stearic acid; long-chain aliphatic alcohols such as eicosanol; carboxylic acid esters of polyhydric alcohols such as glycerol and pentaerythritol, and long chain aliphatic acids or partial esters thereof; and higher aliphatic acid amides such as oleic acid amide and stearic acid amide; and low molecular polyesters.

Among these waxes, those having a melting point of not less than 40° C. are preferred, with a melting point of not less than 50° C. being more preferred to improve the fixability of the toner. Further, it is preferred that the wax have a melting point of not higher than 90° C., more preferably not higher than 80° C. If the melting point of wax is too low, the wax may be exposed on the surface of the toner after fixing, which is liable to produce a sticky feel. On the contrary, if the melting point is too high, the toner can be deteriorated in fixability at a low temperature.

As the wax compound, an ester-based wax obtained from an aliphatic carboxylic acid and a monovalent or polyvalent alcohol is preferably used. The alcohol used may be an aliphatic alcohol. Among ester-based waxes, those having 20 to 100 carbon atoms are more preferable and those having 30 to 60 carbon atoms are particularly preferable.

Among esters of a monovalent alcohol and an aliphatic carboxylic acid, behenyl behenate and stearyl stearate are most preferred. Among esters of a polyvalent alcohol and an aliphatic carboxylic acid, stearic acid ester of pentaerythritol and the partial ester thereof, montanic acid ester of glycerol and the partial ester thereof are most preferred.

The above-described waxes can be used alone or in any mixture thereof. Further depending upon the fixing temperature of the toner, the melting point of a wax compound can be optionally selected. In the context of the present invention the term "wax" can refer to a single wax compound or a mixture of wax compounds.

For the purpose of enhancing fixability, a mixture of two or more, preferably three or more wax compounds is particularly effective. In particular, it is preferable that three or more wax compounds are used together and that formulation amounts of respective compounds preferably do not exceed 60 w/w %, more preferably 45 w/w % and most preferably 40 w/w %, of the entire wax.

When using mixtures of wax compounds, it is preferable that at least one of the waxes is the above-described carboxylic acid ester of a monovalent or polyvalent alcohol. In another embodiment, at least two wax compounds are aliphatic alcohol esters of an aliphatic carboxylic acid having 20 to 100 carbon atoms. The wax compound present in the highest amount is more preferably an alkanoic acid ester of a monovalent or a polyvalent alcohol, most preferably an alkyl ester of an alkanoic acid. In the case where the most abundant wax compound is an alkyl ester of an alkanoic acid, the second most abundant wax compound is preferably a different alkyl ester of an alkanoic acid or alkanoic acid ester of a polyvalent alcohol.

Mixtures of wax compounds more preferably contain 4 or more wax compounds, most preferably 5 or more wax compounds. The upper limit of wax compounds in the mixture is not particularly limited. However, in view of production, it is preferably 50 different wax compounds or less.

If at least three kinds of wax compounds are present, the sum of the two most abundant wax compounds is preferably 88% or less, more preferably 85% or less, and particularly preferably 80% or less.

The wax compound most abundant in the mixture preferably has a melting point of 40° C. or more, more preferably 50° C. or more. Further, the wax compound most abundant in the mixture preferably has a melting point of 90° C. or less, more preferably 80° C. or less. Further, particularly preferably, the two most abundant wax compounds each have a melting point of 40° C. to 90° C.

In the present invention, the wax is used as an emulsion (particulate wax) by dispersing the same in the presence of an emulsifier.

The emulsion is used for seed polymerization of monomer. Specifically, it is used for the formation of particulate resin or primary polymer particles comprising wax encapsulated therein. Alternatively, the wax is incorporated in a toner by co-agglomerating emulsion and latex (dispersion of primary polymer particles).

Surfactant

Particulate wax to be used in the present invention is obtained by emulsifying the above-described wax in the presence of at least one emulsifier selected from known cationic surfactant, anionic surfactant or nonionic surfactant. Two or more kinds of these surfactants can be used together.

The wax used in the present invention has a melting point of 30 to 100° C. Thus, since the wax has a melting point of less than the boiling point of water, where the dispersion of wax particles is prepared by emulsifying the wax, the wax is preferably dispersed and emulsified in a molten state i.e. by heating a mixture of wax, water and emulsifier to the temperature of the melting point of the wax or more. The particulate wax may be produced by dispersing one or more wax compounds in water having a temperature higher than a melting temperature of the particulate wax, in the presence of an emulsifier.

Specific examples of suitable cationic surfactants include dodecyl ammonium chloride, dodecyl ammonium bromide, dodecyl trimethyl ammonium bromide, dodecyl pyridinium chloride, dodecyl pyridinium bromide, and hexadecyl trimethyl ammonium bromide.

Specific examples of suitable anionic surfactants include aliphatic soap such as sodium stearate and sodium dodecanate, sodium dodecyl sulfate,sodium dodecylbenzenesulfonate, and sodium laurylsulfate.

Specific examples of suitable nonionic surfactants include polyoxyethylenedodecyl ether, polyoxyethylenehexadecyl ether, polyoxyethylenenonylphenyl ether, polyoxyethylenelauryl ether, polyoxyethylene sorbitan monoleate ether, and monodecanoyl succrose.

Among these surfactants, an alkali metal salt of a straight chain alkylbenzene sulfonic acid is preferable. The volume-average particle diameter of the particulate wax is preferably from 0.01 $\mu$m to 3 $\mu$m, more preferably from 0.1 $\mu$m to 2 $\mu$m, and particularly from 0.3 to 1.5 $\mu$m. For the measurement of average particle diameter, LA-500 produced by Horiba Co., Ltd. may be used. If the average particle diameter of the particulate wax exceeds 3 $\mu$m, the polymer particles obtained by seed polymerization can be too large to produce a high resolution toner. On the contrary, if the average particle diameter of the emulsion falls below 0.01 $\mu$m, it may be difficult to prepare the dispersion thereof.

Primary Polymer Particles

One feature of the present invention resides in the use of a crosslinked resin as the resin constituting the primary polymer particles and/or the particulate resin, as described below.

The primary polymer particles used in the present invention are obtained by emulsion polymerization of a monomer mixture. In the emulsion polymerization, particulate wax can be used as seed, which is desirable in view of dispersibility of the wax in the toner.

In order to effect seed emulsion polymerization, a monomer having a Brönsted acidic group (hereinafter, referred to as simply an acidic group) or a monomer having a Brönsted basic group (hereinafter, referred to as simply a basic group) and a monomer having neither a Brönsted acidic group nor a Brönsted basic group (hereinafter, also referred to as other monomer) are successively added to cause polymerization in the emulsion containing particulate wax. During this procedure, these monomers may be added separately or concurrently in any combination. Alternatively, a plurality of monomers may be previously mixed before being added. Further, the composition of monomers to be added may be changed during addition. Moreover, these monomers may be added as they are or in the form of an emulsion obtained by mixing with water and/or a surfactant. As such a surfactant, one or more of the exemplified surfactants may be used.

During the seed emulsion polymerization process, an emulsifier (a surface active agent) may be added to the wax emulsion in a predetermined amount. A polymerization initiator may be added before, at the same time with or after the addition of the monomers. These addition methods may be employed in combination.

Examples of the monomer having a Brönsted acidic group usable in the present invention include monomers having a carboxylic group such as acrylic acid, methacrylic acid, maleic acid, fumaric acid and cinnamic acid, monomers having a sulfonic group such as styrene sulfonate, and monomers having a sulfonic amide group such as vinyl benzene sulfonamide.

Particularly preferred monomers for the primary particles are acrylic acid and/or methacrylic acid, with or without other comonomers.

Examples of the monomer having a Brönsted basic group include aromatic vinyl compounds having an amino group such as aminostyrene; monomers containing a nitrogen-containing heterocycle such as vinylpyridine and vinylpyrrolidone; and (meth)acrylic acid esters having an amino group such as dimethylaminoethyl acrylate and diethylaminoethyl methacrylate.

Further, these monomers having an acidic group and monomers having a basic group can be present as salts with respective counter ions.

The amount of monomer having a Brönsted acidic group or a Brönsted basic group in a monomer mixture used to prepare the primary polymer particles is preferably 0.05% by weight or more, more preferably 0.5% by weight or more, and most preferably 1% by weight or more. Further, the amount of monomers having an acidic or basic group is preferably 10% by weight or less, more preferably 5% by weight or less. The amount of monomer having a Brönsted acidic group or a Brönsted basic group in the monomer mixture used to prepare the primary polymer particles can be in a range of from 0.5% by weight to 5% by weight.

Examples of the other comonomers used herein include styrenes such as styrene, methylstyrene, chlorostyrene, dichlorostyrene, p-tert-butylstyrene, p-n-butylstyrene and p-n-nonylstyrene; and (meth)acrylic acid esters such as methyl acrylate, ethyl acrylate, propyl acrylate, n-butyl acrylate, isobutyl acrylate, hydroxyethyl acrylate, ethylhexyl acrylate, methyl methacrylate, ethyl methacrylate, propyl methacrylate, n-butyl methacrylate, isobutyl methacrylate, hydroxyethyl methacrylate and ethylhexyl methacrylate; acrylamide, N-propylacrylamide, N,N-dimethylacrylamide, N,N-dipropylacrylamide, N,N-dibutylacrylamide, and acrylic amide. Particularly preferred among these monomers are styrene, butyl acrylate.

Where a crosslinked resin is used as the primary polymer particles, as a crosslinking agent to be used together with the above-described monomers, radically polymerizable polyfunctional monomers can be used. However, it is possible to produce primary polymer particles from a monomer mixture substantially free of a polyfunctional monomer. Examples of such radically polymerizable polyfunctional monomers include divinyl benzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol diacrylate and diallyl phthalate. Further, monomers having a reactive group in a pendant group, such as glycidyl methacrylate, methylol acrylamide and acrolein can be used.

Preferably, radically-polymerizable bifunctional monomers, more preferably, divinyl benzene and hexanediol diacrylate are desirably used.

The amount of such a polyfunctional monomer used in the monomer mixture is preferably 0.005% by weight or more, more preferably 0.01% by weight or more and particularly preferably 0.05% by weight or more. Further, the amount of polyfunctional monomer is preferably 5% by weight or less, more preferably 3% by weight or less, and particularly preferably 1% by weight or less.

The polyfunctional monomers may be used singly or in admixture, and are preferably added such that the resulting polymer exhibits a glass transition temperature of from 40° C. to 80° C. If the glass transition temperature of the polymer exceeds 80° C., the resulting toner exhibits too high a fixing temperature. Further, the toner may have a decreased OHP transparency. On the contrary, if the glass transition temperature of the polymer falls below 40° C., the storage stability of the toner deteriorates.

Examples of polymerization initiators that can be used include, but are not limited to, persulfates such as potassium persulfate, sodium persulfate and ammonium persulfate; redox initiators obtained by combining these persulfates as one component with reducing agents such as acidic sodium sulfite; water-soluble polymerization initiators such as hydrogen peroxide,4,4'-azobiscyanovaleric acid, t-butyl hydroperoxide and cumene hydroperoxide; redox initiators obtained by combining these water-soluble polymerization initiators as one component with reducing agents such as ferrous salt; benzoyl peroxide, and 2,2'-azobisisobutylonitrile. These polymerization initiators may be added before, at the same time with or after the addition of the monomers. These addition methods may also be employed in combination.

In the present invention, any known chain transfer agent may be used, as desired. Suitable examples of chain transfer agents include, but are not limited to, t-dodecyl mercaptan, 2-mercaptoethanol, diisopropyl xanthogen, carbon tetrachloride, and bromotrichloromethane. These chain transfer agents may be used singly or in combination. The chain transfer agents may be used in an amount of from 0 to 5% by weight based on the weight of the polymerizable monomers used.

The primary polymer particles obtained as described above have a wax substantially encapsulated therein. The primary polymer particles can have any desired morphology, such as, core-shell type, phase separation type, occlusion type or combinations or mixtures thereof. A particularly preferred morphology is a core-shell type particle. Components other than wax, such as a pigment and a charge control agent, can be further used as seed so far as they don't depart from the scope of the present invention. Further, a colorant and a charge control agent dissolved or dispersed in wax can be used.

The volume-average particle diameter of the primary polymer particles can be any size, but is generally from 0.02 to 3 μm, preferably from 0.05 to 3 μm, more preferably from 0.1 to 2 μm and most preferably 0.1 to 1 μm. For the measurement of volume average particle diameter, for example, UPA (Ultra Particle Analyzer produced by Nikkiso Co., Ltd.) may be used. If the particle diameter is less than 0.02 μm, the agglomeration rate can be difficult to controlled. If the particle diameter exceeds 3 μm, the toner obtained by agglomeration may have too large a particle diameter to provide a high resolution toner.

In the present invention, primary polymer particles are agglomerated to form an agglomerate of particles. Within the context of the present invention, the agglomerate of particles can take the form of an agglomerate where the individual particles are still distinguishable to a unitary large particle where the individual primary particles have coalesced to the point of no longer being distinguishable and the entire spectrum of species therebetween. However, in a preferable embodiment, a particulate resin (as described below) is further adhered or fixed thereto to form a toner. In such a toner, the primary polymer particles or the particulate resin for coating an agglomerate of primary particles, or both have a THF insoluble portion.

Therefore, in a toner wherein no particulate resin coating is present, a crosslinked resin is preferred as the primary polymer particles. In a toner having a particulate resin coating, at least one of the primary polymer particles or particulate resin comprises a crosslinked resin. A most preferred embodiment is the case wherein both primary polymer particles and particulate resin are crosslinked resins. The THF insoluble content of the primary polymer particles is generally 15 w/w % or more, preferably 20 w/w % or more, more preferably 25 w/w % or more. Additionally, the THF insoluble content is preferably 70% or less.

If the crosslinking degree is too low, offset can occur. Further, if the crosslinking degree is too high, OHP transparency may be decreased.

In the present invention, the THF insoluble content of the primary polymer particles and optionally used particulate resin, is controlled to provide a final toner having a THF insoluble content of from 15 to 80 w/w %.

Among components constituting the primary polymer particles, a THF soluble component preferably has a molecular weight peak (Mp) of 30,000, more preferably 40,000 or more. Further, the Mp is preferably 150,000 or less, more preferably 100,000 or less.

When a crosslinked resin is used, a THF soluble component preferably has a molecular weight peak of 100,000 or less, more preferably 60,000 or less.

When the molecular weight peak is noticeably smaller than the above-described range, the offset property of the toner at high temperature side can be poor. When the molecular weight peak is noticeably larger than the above-described range, the offset property of the toner at low temperature may be deteriorated.

Among components constituting primary polymer particles, those soluble in tetrahydrofuran have a weight-average molecular weight (Mw) of preferably 30,000 or more, more preferably 80,000 or more, a weight-average molecular weight (Mw) of preferably 500,000 or less, more preferably 300,000 or less.

Colorant

In accordance with the present invention, preferably, primary polymer particles and primary colorant particles are simultaneously agglomerated to form an agglomerate of the particles, to provide a toner or a toner core material. Suitable colorant particles include inorganic or organic pigments and organic dyes, alone or in combination as desired. Specific examples of suitable colorants include known dyes and pigments such as aniline blue, phthalocyanine blue, phthalocyanine green, hansa yellow, rhodamine dye or pigment, chrome yellow, quinacridone, benzidine yellow, rose bengal, triallylmethane dye, monoazo dyes or pigments, disazo dyes or pigments, and condensed azo dyes or pigments. These dyes or pigments may be used singly or in admixture. If the toner of the present invention is a full-color toner, benzidine yellow, monoazo dyes or pigments or condensed azo dyes or pigments are preferably used as a yellow dye or pigment, quinacridone dyes or pigments or monoazo dyes or pigments are preferably used as a magenta dye or pigment, and phthalocyanine blue is preferably used as a cyan dye or pigment. The colorant is normally used in an amount of from 3 to 20 parts by weight based on 100 parts by weight of the binder resin used. In the context of the present invention, the term "binder resin" refers to the total of primary polymer particles and particulate resin (if present).

In one embodiment, a magenta colorant compound represented by the following formulae (I) or (II) is is used in a toner of the present invention having a particulate resin coating. Namely a colorant compound represented by the formula (I) can desirably prepare a primary colorant particle dispersion and, therefore, the resulting toner can have a desirable hue. Since a compound represented by the formula (II) is likely to be positively charged, in the case where it is used for a negatively charged toner, the agglomerate of particles containing the colorant (toner core material) is coated with particulate resin so that the colorant is not exposed. Thus, the toner can be negatively charged. When a compound represented by the formula (I) or (II) is included in a toner obtained by an emulsion polymerization agglomeration method, a desirable magenta hue can be obtained. Thus, the compound represented by the formula (I) or (II) can be especially advantageous as the colorant of the toner of the present invention.

(I)

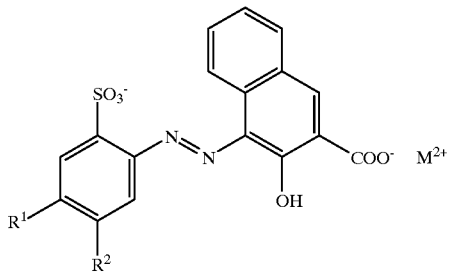

wherein $R^1$ and $R^2$ each independently represents a hydrogen atom, an alkyl group, an alkyl group having 1 to 8 carbons or a halogen atom, provided that at least one of $R^1$ and $R^2$ is a halogen atom, and M represents Ba, Sr, Mn, Ca or Mg.

(II)

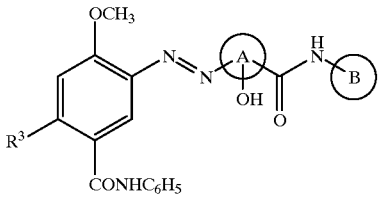

wherein A and B each, independently, represent an aromatic ring which can be substituted, and $R^3$ represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

In the general formula (II), A and B preferably represent a benzene ring or a naphthalene ring. Among compounds represented by formula (II), those represented by the following formula (IIa) are more preferred:

(IIa)

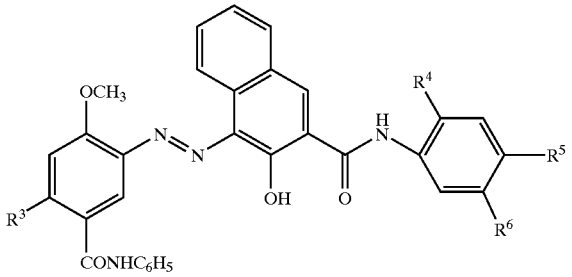

wherein $R^3$ to $R^6$ each independently represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

In the formula (IIa), the nitrogen atom of the aminosulfonyl group or aminocarbonyl group, can be substituted with an alkyl group, an aryl group, an alkoxyalkyl group, a haloalkyl group or a haloaryl group.

Further, a compound wherein $R^3$ is a hydrogen atom, $R^4$ is a methoxy group, $R^5$ is a hydrogen atom and $R^6$ is a chlorine atom is the most preferable in view of spectral reflectance, dispersibility in a polymerizable monomer and a processability to a colorant dispersion.

In the case where these colorants are used by emulsifying in water in the presence of an emulsifier to form an emulsion, those having a volume-average particle diameter of 0.01 to 3 $\mu$m are preferably used.

Charge Control Agent

In the present invention, a charge control agent can be included in the toner if desired. The charge control agent can be incorporated into the toner, preferably by a method wherein the charge control agent is used as seed together with wax in obtaining primary polymer particles, a method wherein the charge control agent is used by dissolving or dispersing in monomer or wax, or a method wherein primary polymer particles and primary charge control agent particles are agglomerated at the same time to form an agglomerate of particles, which is used as a toner. However, a preferable method comprises adhering or fixing a charge control particle before, during or after the process for adhering or fixing particulate resin. In this case, it is preferable that the charge control agent is also used as an emulsion in water having an average particle diameter of from 0.01 to 3 $\mu$m (primary charge control agent particles).

At least a substantial portion of the agglomerate particles which contains at least primary polymer particles and primary colorant particles is coated with the particulate charge control agent. Any conventional charge control agent can be used alone or in combination of two or more. For example, a quaternary ammonium salt, and a basic electron-donating metal material are preferably used as a positively-charging charge control agent, and a metal chelate, a metal salt of an organic acid, a metal-containing dye, nigrosine dye, an amide group-containing compound, a phenol compound, naphthol compound and the metal salts thereof, an urethane bond-containing compound, and an acidic or an electron-attractive organic substance are preferably used as a negatively-charging charge control agent.

Taking into account adaptability to color toner (the charge control agent itself is colorless or has a light color and hence doesn't impair the color tone of a toner), a quaternary ammonium salt compound is preferably used as a positively-charging charge control agent and a metal salt or metal complex of salicylic acid or alkylsalicylic acid with chromium, zinc or aluminum, a metal salt or metal complex of benzylic acid, amide compound, phenol compound, naphthol compound, phenolamide compound, and hydroxynaphthalene compound such as 4,4,'-methylenebis[2-[N-(4-chlorophenyl)amide]-3-hydroxynaphthalene are preferably used as a negatively-charging charge control agent. The amount of the charge control agent to be used may be determined by the required charged amount of toner. In practice, however, it is normally from 0.01 to 10 parts by weight, preferably from 0.1 to 10 parts by weight, based on 100 parts by weight of the binder resin used.

Particulate Resin

In the toner of the present invention, if desired, particulate resin can be coated (adhered or fixed) over the above-described agglomerate of particles to form toner particles.

The particulate resin is preferably used as an emulsion obtained by dispersing the same with an emulsifier (the above-described surface active agent) in water or a liquid mainly comprising water. The particulate resin used in the outermost layer of the toner is preferably substantially free from wax, more preferably containing <1% wax by weight of particulate resin.

Preferred particulate resins, include those having a volume-average particle diameter of 0.02 to 3 $\mu$m, more preferably 0.05 to 1.5 $\mu$m. The particulate resin can comprise units obtained from the same monomers used to prepare the primary polymer particles or can use different monomers from those used in the primary particles.

When the toner is prepared by coating an agglomerate of particles with particulate resin, the particulate resin is preferably a crosslinked resin. In the present invention, it is most preferred that at least one of the primary polymer particles or particulate resin be crosslinked. As the crosslinking agent, the polyfunctional monomers used for the primary polymer particles can be used.

When the particulate resin is a crosslinked resin, the crosslinking degree is normally 5 w/w % or more, preferably 10 w/w % or more and more preferably 15 w/w % or more, based on measurements of THF insoluble content. More preferably, the particulate resin has a THF insoluble content of 70 w/w % or less. In order to achieve the above-described preferable range of THF insoluble content, the formulation amount of polyfunctional monomer is preferably 0.005% by weight or more, more preferably 0.01% or more and most preferably 0.05% or more, based on total monomer mixture used for preparing the particulate resin. Further, the amount of polyfunctional monomer is preferably 5% by weight or less, more preferably 3% by weight or less, and most preferably 1% by weight or less, based on total monomer mixture.

Among components of the particulate resin, a molecular peak (Mp) of THF-soluble components is preferably 30,000 or more, more preferably 40,000 or more, and is preferably 150,000 or less, more preferably 100,000 or less.

Particularly, in the case where a crosslinked resin is used, a molecular peak (Mp) of THF-soluble components is preferably 100,000 or less, more preferably 60,000 or less.

Among components of the particulate resin, a weight-average molecular weight (Mw) of THF-soluble components is preferably 30,000 or more, more preferably 50,000 or more, preferably 500,000 or less, more preferably 300,000 or less.

When the toner is coated with a particulate resin, however, the resulting toner can have a core-shell construction (with the primary polymer particles and colorant particles agglomerated in the core and the particulate resin coated on the outside) or it is also possible the during the aging of the toner with the particulate resin present, there is migration of particulate resin into the agglomerate with concomitant migration of the primary polymer particles and/or colorant particles into the outside coating layer. This can result in the outer layer containing slight amounts of primary polymer particles and colorant particles or even in the extreme, in a toner that is homogeneous with respect to primary polymer particles, colorant particles and particulate resin. All embodiments between distinct layers and homogeneous toner are included in the present invention.

In the case where the toner is a negatively charged toner, it is preferred to have the agglomerate coated with the particulate resin. If aging of the particulate resin coated agglomerate results in mixing to the point wherein no boundary exists between the agglomerate and the particulate resin, it is further preferred to provide an outer layer of particulate resin only.

Additionally, even when there is a distinct layer on the agglomerated primary polymer particles and colorant particles, the layer can completely cover the agglomerate or can be on a substantial portion, either continuously or non-continuously. Preferably, the particulate resin forms a coating on at least 75% of the surface area of the agglomerate, more preferably at least 85%, even more preferably at least 95%. Most preferably is a complete covering of the agglomerate with the particulate resin.

Agglomeration Process

In a preferred embodiment of the present invention, the above-described primary polymer particles, primary colorant particles, and optionally particulate charge control agent, particulate wax and other additives are emulsified to form an emulsified liquid, which are co-agglomerated to form an agglomerate of particles. Among respective components to be agglomerated, the charge control agent dispersion, particulate wax or other additives can be added during the agglomeration process or after the agglomeration process.

Embodiments of the agglomeration process include 1) methods wherein agglomeration is effected by heating, and 2) methods wherein agglomeration is effected chemically, such as by addition of an electrolyte.

In the case where agglomeration is effected by heating, the agglomeration temperature is preferably in a range of from 5° C. to Tg (Tg is the glass transition temperature of primary polymer particles), more preferably a range of from (Tg−10° C.) to (Tg−5° C.). By employing this preferred temperature range, a desirable toner particle diameter can be obtained by agglomeration without using a chemical additive, such as an electrolyte.

In the case where agglomeration is effected by heating, the method can further comprise an aging step subsequent to the agglomeration step. The aging step is described in more detail below. The agglomeration step and the aging step are effected sequentially and, therefore, the boundary between these processes is not necessarily clear cut. However, a process wherein a temperature range of from (Tg−20° C.) to Tg is maintained for at least 30 minutes is defined herein as an agglomeration step.

The agglomeration temperature is preferably a temperature at which toner particles having a desired particle diameter are formed, by keeping the mixture for at least 30 minutes at the given temperature. To reach the given temperature, temperature can be elevated at a constant speed or stepwise. The holding time is preferably from 30 minutes to 8 hours, more preferably from 1 hour to 4 hours in a temperature range of from (Tg−20° C.) to Tg. Thus, a toner having a small particle diameter and sharp particle size distribution can be obtained.

In the process of the present invention, the particulate resin and/or particulate charge control agent can each, independently, be added to the process before or during the agglomeration step, between the agglomeration step and aging step, during the aging step or after the aging step. Further, if either component is added after the aging step, a second aging step can be performed if desired, under the same conditions noted above for the aging step.

In the case where agglomeration is effected by use of electrolyte, the electrolyte can be combined with a mixed dispersion of primary polymer particles, colorant particles, and optionally other components. Suitable electrolytes can be organic salts or inorganic salts. A monovalent or polyvalent (divalent or more) metal salt is preferable. Specifically, mention may be made of NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$ and $C_6H_5SO_3Na$.

The amount of electrolyte to be added varies depending on the particular one chosen, and is, in practice, used in an amount of from 0.05 to 25 parts by weight, preferably from 0.1 to 15 parts by weight, more preferably from 0.1 to 10 parts by weight based on 100 parts by weight of the solid content of mixed dispersion used (wherein the mixed dispersion comprises, at least primary polymer particles and colorant particles).

If the amount of electrolyte to be added is significantly smaller than the above-described range, various problems tend to occur. Namely, the agglomeration reaction proceeds so slowly that finely divided particles having a diameter of not more than 1 $\mu$m are left behind after the agglomeration reaction or the average particle diameter of the aggregates of particles thus obtained is not more than 3 $\mu$m. Further, if the amount of electrolyte added significantly exceeds the above-described range, various other problems also can occur.

Namely, the agglomeration reaction may proceed too rapidly to control. The resulting agglomerate of particles contains coarse particles having a particle diameter of not less than 25 μm or have an irregular amorphous form.

Further, in the case where agglomeration is effected by adding an electrolyte, the agglomeration temperature is preferably in the range of from 5° C. to Tg.

As noted above, in order to enhance the stability of the aggregates (toner particles) obtained in the agglomeration step, an aging step (causing the fusion of agglomerated particles to each other) at a temperature of from Tg to (Tg+80° C. or more), preferably (Tg+20° C.) to (Tg+80° C.), but below the softening point temperature of the primary polymer particles may be preferably added. The addition of the aging step makes it possible to substantially round the shape of the toner particles or control the shape of the toner particles. This aging step is normally performed for a time of from 1 hour to 24 hours, preferably from 1 hour to 10 hours.

The agglomeration step can be performed in any suitable apparatus, but is preferably performed in a reaction tank with agitation. Substantially cylindrical or spherical reaction tanks are preferably used. When the reaction tank is substantially cylindrical, the shape of the bottom thereof is not particularly limited. However, generally a reaction tank having a substantially circular bottom is preferably used.

In order to improve agitation efficiency, the volume of the mixed dispersion is preferably ¾ or less, preferably ⅔ or less of the volume of the reaction tank. When the volume of the mixed dispersion is significantly smaller than that of the reaction tank, the dispersion bubbles violently, increasing the viscosity. As a result, coarse particles tend to be formed, agitation sometimes cannot occur effectively depending upon the shape of an agitating blade, and, the productivity is lowered. Thus, the above-described volume ratio is preferably 1/10 or more, more preferably ⅕ or more.

As an agitating blade to be used in the agglomeration step, any agitating blade can be used, such as conventionally known commercially available agitating blades. Suitable commercially available agitating blades, include anchor blades, full zone blades (produced by Shinko Pantec Co., Ltd.), Sunmeler blades (produced by Mitsubishi Heavy Industries, Ltd.), Maxblend blades (Sumitomo Heavy Industries, Ltd.), Hi-F mixer blades (produced by Souken Kagaku K.K.) and double helical ribbon blades (produced by Shinko Pantec Co., Ltd.). A baffle may also be provided in the agitating tank if desired.

Generally, the agitating blade is selected and used depending upon the viscosity and other physical properties of the reaction liquid, the reaction itself, and the shape and size of the reaction tank. Such selection is within the skill of the ordinary artisan. As a preferred agitating blade, however, specific mention may be made of a double helical ribbon blade or anchor blade.

The Other Additives

The toner according to the present invention can be used together with one or more other additives such as a fluidity improver as desired. Specific examples of such fluidity improvers include finely divided hydrophobic silica powder, finely divided titanium oxide powder and finely divided aluminum oxide powder. The fluidity improver is, when present, normally used in an amount of from 0.01 to 5 parts by weight, preferably from 0.1 to 3 parts by weight based on 100 parts by weight of the binder resin used.

Further, the toner according to the present invention may contain an inorganic particulate material such as magnetite, ferrite, cerium oxide, strontium titanate and electrically conductive titania or a resistivity adjustor or lubricant, such as styrene resin or acrylic resin, as an internal or external additive. The amount of such an additive to be added may be properly predetermined depending on the desired properties. In practice, however, it is preferably from 0.05 to 10 parts by weight based on 100 parts by weight of the binder resin used.

The toner of the present invention may be in the form of either a two-component developer or a non-magnetic one-component developer. The toner of the present invention, if used as a two-component developer, may have any known carrier such as magnetic materials (including iron powders, magnetite powders, ferrite powders,) materials obtained by coating the surface of such a magnetic material with a resin and magnetic carriers. As the coating resin to be used in the resin-coated carrier there may be used generally known resins, such as styrene resin, acrylic resin, styrene-acryl copolymer resin, silicone resin, modified silicone resin, fluororesin or mixture thereof.

Toner

The toner of the present invention produced by using the above-described respective components, comprises a resin wherein at least one of primary polymer particles or particulate resin are crosslinked. When a crosslinked resin is used, the THF insoluble content is high. When an uncrosslinked resin is used, it is substantially dissolved in THF. Generally, the colorant is not THF soluble. Further, although the charge control agent is sometimes THF-soluble and sometimes THF insoluble, the charge control agent is used in a small proportion compared with the other components. By taking these facts into consideration, the THF insoluble content of the toner of the present invention is controlled in a range of from 15 to 80 w/w %. The tetrahydrofuran insoluble content is preferably 20 w/w % or more, and is preferably 70 w/w % or less.

In the toner of the present invention when both primary polymer particles and particulate resin are crosslinked, which is a most preferred embodiment of the present invention, the THF insoluble content of the toner is 20 to 70 w.w %, preferably 30 to 70 w/w %.

The THF insoluble content of the binder resin contained in the toner is preferably from 10 to 70% by weight, more preferably from 20 to 60% by weight.

Further, though it depends on the monomer composition of the primary polymer particles and the particulate resin, the THF insoluble content of the binder resin contained in the toner tends to be lower than the THF insoluble content of the primary polymer particles, particularly in the case of preparing the toner using an aging or fusion-bonding step (i.e. the primary particles become at least partially fused).

The toner of the present invention further comprises wax having a melting point of 30 to 100° C. The content thereof in the toner is preferably 1 part by weight or more, more preferably 5 parts by weight or more and particularly preferably 8 parts by weight or more to 100 parts by weight of a binder resin of the toner (wherein the term "binder resin" is used herein to mean the sum of the resin constituting primary polymer particles and the resin constituting particulate resin, as described earlier). The wax content is also preferably 40 parts by weight or less, more preferably 35 parts by weight or less and most preferably 30 parts by weight or less.

When the toner of the present invention is used in a printer or a copying machine having high resolution, the toner preferably has a relatively small particle size and has a sharp particle size distribution for attaining a uniform charged amount in respective toner particles.

The average volume particle diameter of the toner of the present invention is preferably 3 to 12 μm, more preferably 4 to 10 μm, particularly preferably 5 to 9 μm. As an index representing particle size distribution, the ratio of volume-average particle diameter ($D_V$) to number-average particle diameter ($D_N$), i.e., (($D_V$)/($D_N$)) is used. The present invention toner preferably has a ($D_V$)/($D_N$) of 1.25 or less, more preferably 1.22 or less and most preferably 1.2 or less. The minimum ($D_V$)/($D_N$) is 1, which means that all particles have the same particle size. This is advantageous in the formation of an image having a high resolution. Practically, however, a particle size distribution of 1 is extremely difficult to be obtained. Accordingly, in view of production considerations, ($D_V$)/($D_N$) is preferably 1.03 or more, more preferably 1.05 or more.

When finely divided powder (toner having excessive small particle diameter) is present in too high an amount, blushing of a sensitizing body and scattering of toner into the inside of an apparatus are likely to occur and the charged amount distribution is also liable to be worse. When coarse powder (toner having excessive large particle diameter) is present in too high an amount, the charged amount distribution is liable to be worse, which is unsuitable for forming a high resolution image. For example, when the toner has an average volume particle diameter of 7 to 10 μm, the amount of toner having a particle diameter of 5 μm or less is preferably 10% by weight or volume or less, more preferably 5% by weight or less of the entire amount of the toner. The amount of toner having a particle diameter of 15 μm or more is preferably 5% by weight or volume or less, more preferably 3% by weight or less.

When such a toner having a relatively small particle diameter and a sharp particle size distribution is produced, the production method according to the emulsion polymerization agglomeration method of the present invention is advantageous compared with suspension polymerization or kneading-pulverizing method.

The 50% circular degree of the present toner is preferably 0.95 or more, more preferably 0.96 or more. (circular degree=circumference length of circle having the same area as that of projected area of particle/circumference length of projected image of particle)The maximum 50% circular degree is 1 which means that the toner is substantially spherical. However, such a toner is difficult to be obtained. Thus, in view of production considerations, it is preferably 0.99 or less.

Preferable Embodiment of the Invention

The toner of the present invention will be further specifically described below in terms of several preferred embodiments.

A first preferred embodiment is a toner wherein particulate resin is adhered or fixed to an agglomerate of particles obtained by agglomerating at least primary polymer particles and primary colorant particles; the THF insoluble content of the primary polymer particles is from 15 to 70 w/w %, preferably from 20 to 70 w/w %; the THF insoluble content of the particulate resin is from 5 to 70 w/w %, preferably from 10 to 70 w/w %; and the toner includes a wax having a melting point of from 30 to 100° C.

A second preferred embodiment is a toner wherein particulate resin is adhered or fixed to an agglomerate of particles obtained by agglomerating at least primary polymer particles and primary colorant particles; the THF insoluble content of the primary polymer particles is from 15 to 70 w/w %, preferably from 20 to 70 w/w %; the particulate resin is not crosslinked; and a wax having a melting point of 30 to 100° C. is included in the toner.

A third preferred embodiment is a toner wherein particulate resin is adhered or fixed to an agglomerate of particles obtained by agglomerating at least primary polymer particles and primary colorant particles; the primary polymer particles are not crosslinked; the THF insoluble content of the particulate resin is from 5 to 70 w/w %, preferably from 10 to 70 w/w %; and a wax having a melting point of 30 to 100° C. is included in the toner.

Among these three preferred embodiments, as primary polymer particles, those obtained by emulsion polymerization using particulate wax having a melting point of 30 to 100° C. as seed are more preferably used.

Further, also among these three preferable embodiments, the THF insoluble content of the primary polymer particles and that of the particulate resin are each most preferably from 15 to 70 w/w %.

Having generally described this invention, a further understanding can be obtained by reference to certain specific examples which are provided herein for purposes of illustration only and are not intended to be limiting unless otherwise specified.

EXAMPLES

The present invention will be further described in the following examples.

The term "parts" as used hereinafter is meant to indicate "parts by weight". For the measurement of the average particle diameter, weight average molecular weight, glass transition point (Tg), 50% circular degree, fixing temperature width, charged amount and blocking resistance of the polymer particles, the following methods were used.

Volume average particle diameter, number average particle diameter, proportion of toner particles having a diameter of 5 μm or less and those having a diameter of 15 μm or more: LA-500 produced by Horiba K.K., MICROTRACK UPA produced by Nikkiso Co., Ltd. or COULTER COUNTER MULTISIZER II model (abbreviated as COULTER COUNTER) produced by Coulter Inc. were employed.

Weight-average molecular weight (Mw), Molecular weight peak (Mp): Gel permeation chromatography (GPC) was employed (apparatus: GPC apparatus HLC-8020 produced by Tosoh Corporation, column: PL-gel Mixed-B 10μ produced by Polymer Laboratory K.K., solvent: THF, sample concentration: 0.1 wt %, calibration curve: standard polystyrene).

Glass transition temperature (Tg): DSC 7 produced by Perkin Elmer Inc. was used (Temperature of toner was elevated from 30° C. to 100° C. for 7 minutes, then the temperature was quickly lowered from 100° C. to −20° C., successively elevated from −20° C. to 100° C. for 12 minutes. The value of Tg observed at the second temperature elevation was adopted).

50% circular degree: Toner was evaluated by flow type particle image analysis apparatus -2000 produced by Sysmex Corporation and circular degree corresponding to cumulative particle size value at 50% of the value determined by the following formula was employed.

Circular degree=circumference length of circle having the same area as that of projected area of particle/circumference length of projected image of particle Fixing temperature width: A recording paper having an unfixed toner image supported thereon was prepared. The recording paper was carried into the fixing nip during which the surface temperature of heated rollers was varied from 100° C. to 220° C. The recording paper discharged from the fixing nip was then observed for fixing conditions. The temperature range within which the heated rollers undergo no toner offset during fixing and the toner which has been fixed to the recording paper was sufficiently bonded to the recording paper was defined as fixing temperature range.

Among the heated rollers in the fixing machine, a soft roller used comprised aluminum as core metal, 1.5 mm-thick dimethyl type low temperature vulcanizable silicone rubber having a rubber hardness of 3° according to JIS-A specification as a resilient layer, and a 50 μm-thick releasing layer comprising PFA (tetrafluoroethylene-perfluoroalkylvinyl ether copolymer). The soft roller had a diameter of 30 mm and a rubber hardness on the fixing roller surface determined according to Japan rubber association specification SRIS 0101 of 80. Evaluation was effected under conditions of a nip width of 4 mm or 31 mm and fixing rates of 120 mm/s or 30 mm/s, without coating the roller with silicone oil.

A hard roller used comprised aluminum as core metal, and a tetrafluoroethylene-perfluoroalkylvinyl ether copolymer (PFA) as a coating layer having a thickness of 50 μm. A resilient layer was not provided. The rubber hardness on the fixing roller surface was 94. The evaluation with the hard roller was effected at fixing rate of 75 mm/s or 19 mm/s and a nip width of 2.5 mm, without coating the roller with silicone oil.

It should be noted that since the evaluation range was 100 to 220° C., a toner described to have the upper limit of a fixing temperature of 220° C. has a possibility of having a true upper limit of a fixing temperature which is higher than 220° C.

OHP transparency: By using the above-described fixing rollers, unfixed toner image on an OHP sheet was fixed under the conditions of a fixing rate of 30 mm/s and 180° C. in the case of the soft roller or a fixing rate of 19 mm/s and 180° C. in the case of the hard roller, without coating the roller with silicone oil. Then, the transmittance was determined in a range of wavelength of from 400 nm to 700 nm by means of a spectrophotometer (U-3210 produced by Hitachi, Ltd.). The difference between the transmittance at the wavelength at which the highest transmittance was observed (maximum transmittance (%)) and the transmittance at the wavelength at which the lowest transmittance was observed (minimum transmittance (%)) (maximum transmittance (%)–minimum transmittance (%)) was employed as OHP transparency.

Charged amount: Toner was charged into a non-magnetic one-component developing cartridge (COLOR PAGE PRESTO N4 developing cartridge, manufactured by Casio Co., Ltd.), then rollers were revolved for a predetermined period, thereafter, the toner on the roller was sucked. A charged amount per unit weight was determined from the charged amount (determined by BLOWOFF produced by Toshiba Chemical Corp.) and the weight of the sucked toner.

Blocking resistance: A 10 g amount of a toner for development was placed into a cylindrical container, then 20 g of load was applied thereto, which was allowed to stand in a circumstance of 50° C. for 5 hours. Thereafter, the toner was taken out from the container and an agglomeration degree was confirmed by applying a load from the above thereto.

A: Agglomeration was not observed

B: Although agglomeration occurred, it was broken by applying a light load.

NG: Agglomeration was formed, which was not broken by applying a load.

Tetrahydrofuran insoluble matter: The determination of THE insoluble matters of toner, primary polymer particles and particulate resin were effected as follows: A 1 g amount of a sample was added to 50 g of tetrahydrofuran, the resulting mixture was dissolved by allowing to stand at 25° C. for 24 hours, successively filtered with 10 g of CELITE. The solvent of the filtrate was distilled off and an amount of the matter soluble in tetrahydrofuran was quantitatively determined. The value obtained was subtracted from 1 g, whereby the amount insoluble in tetrahydrofuran was calculated.

Melting point of wax: Determination was effected at a temperature elevation rate of 10° C./min. using DSC-20 produced by Seiko Instruments Inc. The temperature of the peak which shows maximum endotherm in DSC curve was employed as the melting point of wax.

Example 1

Wax Dispersion 1

A 68.33 part amount of desalted water, 30 parts of 7:3 mixture of an ester mixture mainly comprising behenyl behenate (UNISTER M2222SL, produced by NOF Corporation) and an ester mixture mainly comprising stearyl stearate (UNISTER M9676, produced by NOF Corporation) and 1.67 parts of sodium dodecylbenzene sulfonate (NEOGEN SC, produced by Dai-ichi Kogyo Seiyaku Co., Ltd., 66% of active component) were mixed, then the resulting mixture was emulsified at 90° C. by applying high pressure shearing to obtain a dispersion of particulate ester wax. An average particle diameter of the particulate ester wax determined by LA-500 was 340 nm.

Further the resulting wax was a mixture composed of about 38% behenyl behenate, about 15% stearyl stearate, about 13% $C_{42}H_{84}O_2$ component, about 12% $C_{40}H_{80}O_2$ component and about 22% of the other components.

Primary Polymer Particle Dispersion 1

Into a reactor (volume 60 liter, inner diameter 400 mm) equipped with an agitator (three blades), a concentrating apparatus, a jacket through which thermostat-regulated water flowed, and an apparatus for charging starting materials and auxiliaries were charged 28 parts of wax dispersion 1, 1.2 parts 15% aqueous solution of NEOGEN SC and 393 parts desalted water, which were then heated to a temperature of 90° C. in a flow of nitrogen. Successively, 1.6 parts 8% aqueous hydrogen peroxide and 1.6 parts 8% aqueous ascorbic acid were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

[Monomers]

| | |
|---|---|
| Styrene | 79 parts (5530 g) |
| Butyl acrylate | 21 parts |
| Acrylic acid | 3 parts |
| Octane thiol | 0.38 part |
| 2-mercaptoethanol | 0.01 part |
| Hexanediol diacrylate | 0.9 part |

-continued

| | |
|---|---|
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 119,000, the average particle diameter determined by UPA was 189 nm and Tg was 57° C.

Particulate Resin Dispersion 1

Into a reactor (volume 60 liter, inner diameter 400 mm) equipped with an agitator (three blades), a concentrating apparatus, a jacket through which thermostat-regulated water flowed, and an apparatus for charging starting materials and auxiliaries were charged 15% aqueous solution of NEOGEN SC 5 parts and desalted water 372 parts, which were then heated to a temperature of 90° C. in a flow of nitrogen. Successively, 1.6 parts 8% aqueous hydrogen peroxide and 8% 1.6 parts aqueous ascorbic acid were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 88 parts (6160 g) |
| Butyl acrylate | 12 parts |
| Acrylic acid | 2 parts |
| Bromotrichloromethane | 0.5 part |
| 2-mercaptoethanol | 0.01 part |
| Hexanediol diacrylate | 0.4 part |
| [Aqueous solution of emulsifier] | |
| 15% aqueous solution of NEOGEN SC | 2.5 parts |
| Desalted water | 24 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 54,000, the average particle diameter determined by UPA was 83 nm and Tg was 85° C.

Particulate Colorant Dispersion 1

Aqueous dispersion of pigment blue 15:3 (EP-700 Blue GA, produced by Dainichiseika Color & Chemicals Mfg. Co., Ltd., solid content 35%), an average particle diameter determined by UPA of 150 nm.

Particulate Charge Control Agent Dispersion 1

A 20 part amount of 4,4'-methylenebis[2-[N-(4-chlorophenyl)amide]-3-hydroxynaphthalene], 4 parts of alkylnaphthalene sulfonate and 76 parts of desalted water were dispersed by means of a sand grinder mill to obtain a particulate charge control agent dispersion. The resulting dispersion had an average particle diameter determined by UPA of 200 nm.

| Production of toner fordevelopment 1 | |
|---|---|
| Primary polymer particle dispersion 1 | 104 parts (71 g as solid content) |
| Particulate resin dispersion 1 | 6 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.6 part as solid content) was dropwise added to the mixed dispersion thus obtained with stirring. Thereafter, with stirring, the mixed dispersion obtained was heated to 51° C., which took 20 minutes, and the mixed dispersion was kept at that temperature for 1 hour, further heated to 58° C. for 6 minutes, where it was kept for 1 hour. Thereafter, particulate charge control agent dispersion, particulate resin dispersion and aqueous aluminum sulfate (0.07 part as the solid content) were successively added, which were heated to 60° C. for 10 minutes. After keeping the resulting mixture for 30 minutes, 15% aqueous solution of NEOGEN SC (3 parts as solid content) was added thereto. The resulting mixture was heated to 95° C. for 35 minutes where the mixture was kept for 3.5 hours. Successively, the mixture obtained was cooled, filtered, washed with water, and then dried to obtain a toner (toner 1).

To 100 parts of the toner thus obtained was mixed 0.6 part of silica having been subjected to hydrophobic surface treatment with stirring to obtain a toner for development (toner for development 1).

Evaluation of Toner 1

The toner for development obtained had a volume average particle diameter determined by COULTER COUNTER of 7.2 $\mu$m. In the resulting toner, the portion having a volume particle diameter of 5 $\mu$m or less was 3.5%. While the portion having a volume particle diameter of 15 $\mu$m or more was 0.5%. The ratio of the volume average particle diameter and the number average particle diameter was 1.12. 50% circular degree of the toner was 0.97.

The fixability of toner for development 1 was evaluated. As the result, at a fixing rate of 120 mm/s, the toner was fixed at a temperature of from 170° C. to 220° C., and at a fixing rate of 30 mm/s, the toner was fixed at a temperature of from 130° C. to 220° C. OHP transparency was 70%.

The charged amount of toner 1 was −7 $\mu$C/g and the charged amount of toner for development 1 was −15 $\mu$C/g. The blocking resistance was A.

Example 2

Wax Dispersion 2

Dispersion prepared as in wax dispersion 1 was used. An average particle diameter of the particulate ester wax obtained determined by LA-500 was 340 nm.

Primary Polymer Particle Dispersion 2

Into a reactor (volume 60 liter, inner diameter 400 mm) equipped with an agitator (three blades), a concentrating apparatus, a jacket through which thermostat-regulated water flowed, and an apparatus for charging starting materials and auxiliaries were charged wax dispersion 1 28 parts, 15% aqueous solution of NEOGEN SC 1.2 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.45 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 148,000, the average particle diameter determined by UPA was 207 nm and Tg was 55° C.

Particulate Resin Dispersion 2

The same particulate resin dispersion as particulate resin dispersion 1 was used.

Particulate Colorant Dispersion 2

A 20 part amount of pigment yellow 74, 7 parts of polyoxyethylenealkylphenyl ether and 73 parts of desalted water were dispersed by means of a sand grinder mill to obtain a particulate colorant dispersion. The resulting dispersion had an average particle diameter determined by UPA of 211 nm.

Particulate Charge Control Agent Dispersion 2

The same particulate charge control agent dispersion as particulate charge control agent dispersion 1 was used.

| Production of toner for development 2 | |
|---|---|
| Primary polymer particle dispersion 2 | 105 parts (as solid content) |
| Particulate resin dispersion 1 | 5 parts (as solid content) |
| Particulate colorant dispersion 2 | 6.7 parts (as solid content) |
| Particulate charge control agent dispersion 1 | 2 parts (as solid content) |

By using the above-described respective components, toner was produced according to the following manner.

To a reactor (volume 1 liter, an anchor blade equipped with a baffle) were charged primary polymer particle dispersion and particulate colorant dispersion, which were uniformly mixed. Aqueous aluminum sulfate (0.6 part as solid content) was dropwise added to the mixed dispersion thus obtained with stirring. Thereafter, with stirring, the mixed dispersion obtained was heated to 51° C., which took 25 minutes, and the mixed dispersion was kept at that temperature for 1 hour, further heated to 59° C. for 8 minutes, where it was kept for 40 minutes. Thereafter, particulate charge control agent dispersion, particulate resin dispersion and aqueous aluminum sulfate (0.07 part as the solid content) were successively added, which were heated to 61° C. for 15 minutes. After keeping the resulting mixture for 30 minutes, 15% aqueous solution of NEOGEN SC (3.8 parts as solid content) was added thereto. The resulting mixture was heated to 96° C. for 30 minutes where the mixture was kept for 4 hours. Successively, the mixture obtained was cooled, filtered, washed with water, and then dried to obtain a toner (toner 2). To 100 parts of this toner thus obtained was mixed 0.6 part of silica having been subjected to hydrophobic surface treatment with stirring to obtain a toner for development (toner for development 2).

Evaluation of Toner 2

Toner for development 2 obtained had a volume average particle diameter determined by COULTER COUNTER of 7.5 μm. In the resulting toner, the portion having a volume particle diameter of 5 μm or less was 1.6%. While the portion having a volume particle diameter of 15 μm or more was 0.7%. The ratio of the volume average particle diameter and the number average particle diameter was 1.14. 50% circular degree of the toner was 0.96.

The fixability of toner for development 2 was evaluated. As the result, at a fixing rate of 120 mm/s, the toner was fixed at a temperature of from 150° C. to 220° C., and at a fixing rate of 30 mm/s, the toner was fixed at a temperature of from 130° C. to 220° C.

The charged amount of toner 2 was −4 μC/g and the charged amount of toner for development 2 was −3 μC/g.

Example 3

Wax Dispersion 3

The same wax dispersion as wax dispersion 1 was used.

Primary Polymer Particle Dispersion 3

The same primary polymer particle dispersion as primary polymer particle dispersion 1 was used.

Particulate Resin Dispersion 3

The same particulate resin dispersion as particulate resin dispersion 1 was used.

Particulate Colorant Dispersion 3

A 20 part amount of pigment red 238 (compound of the following formula (A)), 2.5 parts of alkylbenzene sulfonate and 77.5 parts of desalted water were dispersed by means of a sand grinder mill to obtain a particulate colorant dispersion. The resulting dispersion had an average particle diameter determined by UPA of 181 nm.

(A)

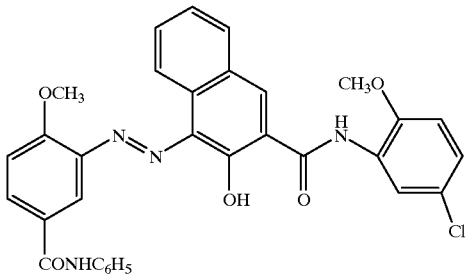

Particulate Charge Control Agent Dispersion 3

The same particulate charge control agent dispersion as particulate charge control agent dispersion 1 was used.

| Production of toner for development 3 | |
|---|---|
| Primary polymer particle dispersion 1 | 104 parts (as solid content) |
| Particulate resin dispersion 1 | 6 parts (as solid content) |
| Particulate colorant dispersion 3 | 6.7 parts (as solid content) |
| Particulate charge control agent dispersion 1 | 2 parts (as solid content) |
| 15% aqueous solution of NEOGEN SC | 0.65 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and the resulting mixed dispersion was uniformly mixed. Aqueous aluminum sulfate (0.8 part as solid content) was dropwise added to the mixed dispersion thus obtained with stirring. Thereafter, with stirring, the mixed dispersion obtained was heated to 51° C., which took 15 minutes, and the mixed dispersion was kept at that temperature for 1 hour, further heated to 59° C. for 6 minutes, where it was kept for 20 minutes. Thereafter, particulate charge control agent dispersion, particulate resin dispersion and aqueous aluminum sulfate (0.09 part as the solid content) were successively added, which were heated to 59° C. and kept at that temperature for 20 minutes. Then, 15% aqueous solution of NEOGEN SC (3.7 parts as solid content) was added thereto. The resulting mixture was heated to 95° C. for 25 minutes and further 15% aqueous solution of NEOGEN SC (0.7 part as solid content) was added, which were kept for 3.5 hours. Successively, the mixture obtained was cooled, filtered, washed with water, and then dried to obtain a toner (toner 3).

To 100 parts of toner 3 thus obtained was mixed 0.6 part of silica having been subjected to hydrophobic surface treatment with stirring to obtain a toner for development (toner for development 3).

Evaluation of Toner 3

The toner for development obtained had a volume average particle diameter determined by COULTER COUNTER of 7.8 μm. In the resulting toner, the portion having a volume particle diameter of 5 μm or less was 2.1%. While the portion having a volume particle diameter of 15 μm or more was 2.1%. The ratio of the volume average particle diameter and the number average particle diameter was 1.15. 50% circular degree of the toner was 0.97.

The fixability of toner for development 3 was evaluated. As the result, at a fixing rate of 120 mm/s, the toner was fixed at a temperature of from 160° C. to 220° C., and at a fixing rate of 30 mm/s, the toner was fixed at a temperature of from 120° C. to 220° C.

The charged amount of toner 3 was −17 μC/g and the charged amount of toner for development 3 was −17 μC/g.

Example 4

Wax Dispersion 4

The wax dispersion prepared as in wax dispersion 1 was used. An average particle diameter of the particulate ester wax obtained determined by LA-500 was 340 nm.

Primary Polymer Particle Dispersion 4

The primary polymer particle dispersion was prepared using the same formulation and procedure as those of primary polymer particle dispersion 2.

The weight average molecular weight of the soluble matter in THF of the polymer was 152,000, the average particle diameter determined by UPA was 200 nm and Tg was 53° C.

Particulate Colorant Dispersion 4

The same particulate colorant dispersion as particulate colorant dispersion 3 was used.

Particulate Charge Control Agent Dispersion 4

The same particulate charge control agent dispersion as particulate charge control agent dispersion 1 was used.

| Production of toner for development 4 | |
|---|---|
| Primary polymer particle dispersion 4 | 110 parts (as solid content) |
| Particulate colorant dispersion 3 | 6.7 parts (as solid content) |
| Particulate charge control agent dispersion 1 | 2 parts (as solid content) |
| 15% aqueous solution of NEOGEN SC | 0.65 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and the resulting mixed dispersion was uniformly mixed. Aqueous aluminum sulfate (0.8 part as solid content) was dropwise added to the mixed dispersion thus obtained with stirring. Thereafter, with stirring, the mixed dispersion obtained was heated to 55° C., which took 23 minutes, and the mixed dispersion was kept at that temperature for 1 hour, further heated to 60° C. for 6 minutes, where it was kept for 25 minutes. Thereafter, particulate charge control agent dispersion was added thereto, which were heated to 59° C. and kept at that temperature for 30 minutes. Then, 15% aqueous solution of NEOGEN SC (4 parts as solid content) was added thereto.

The resulting mixture was heated to 96° C. for 28 minutes and kept for 5 hours at that temperature. Successively, the mixture obtained was cooled, filtered, washed with water, and then dried to obtain a toner (toner 4).

To 100 parts of toner 4 thus obtained was mixed 0.6 part of silica having been subjected to hydrophobic surface treatment with stirring to obtain a toner for development (toner for development 4).

Evaluation of Toner 4

Toner for development 4 obtained had a volume average particle diameter determined by COULTER COUNTER of 8.2 μm. In the resulting toner, the portion having a volume particle diameter of 5 μm or less was 1.1%. While the portion having a volume particle diameter of 15 μm or more was 1.8%. The ratio of the volume average particle diameter and the number average particle diameter was 1.15. 50% circular degree of the toner was 0.94.

The fixability of toner for development 4 was evaluated. As the result, at a fixing rate of 120 mm/s, the toner was fixed at a temperature of from 180° C. to 220° C., and at a fixing rate of 30 mm/s, the toner was fixed at a temperature of from 150° C. to 210° C.

The charged amount of toner 4 was −20 μC/g and the charged amount of toner for development 4 was −15 μC/g.

Example 5

Wax Dispersion 5

A 68.33 amount of desalted water, 30 parts of stearic acid ester of pentaerythritol (UNISTER 11476, produced by NOF Corporation) and 1.67 parts of sodium dodecylbenzene sulfonate (NEOGEN SC, produced by Dai-ichi Kogyo Seiyaku Co., Ltd., 66% of active component) were mixed, then the resulting mixture was emulsified at 90° C. by applying high pressure shearing to obtain a particulate ester wax dispersion. An average particle diameter of the particulate ester wax obtained determined by LA-500 was 350 nm.

Further, the resulting wax comprised mainly stearic acid ester of pentaerythritol, in which about 90% of the hydroxyl groups derived from pentaerythritol are esterified and about 10% thereof are unchanged, and the carboxylic acid moiety is composed of about 67% $C_{18}$ component, about 29% $C_{16}$ component and about 4% of other components.

Primary Polymer Particle Dispersion 5

Into a reactor (volume 2 liter, inner diameter 120 mm) equipped with an agitator (full zone blade), a concentrating apparatus, a jacket through which thermostat-regulated water flows, and an apparatus for charging starting materials and auxiliaries were charged wax dispersion 35 parts and desalted water 397 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts (237 g) |
| Butyl acrylate | 21 parts |
| Acrylic acid | 3 parts |
| Octane thiol | 0.38 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 139,000, the average particle diameter determined by UPA was 201 nm and Tg was not clear.

Particulate Resin Dispersion 5

Into a reactor (volume 2 liter, inner diameter 120 mm) equipped with an agitator (three backward blades), a concentrating apparatus, a jacket through which thermostat-regulated water flows, and an apparatus for charging starting materials and auxiliaries were charged 15% aqueous solution of NEOGEN SC 6 parts and desalted water 372 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 88 parts (308 g) |
| Butyl acrylate | 12 parts |
| Acrylic acid | 2 parts |
| Bromotrichloromethane | 0.5 part |
| 2-mercaptoethanol | 0.01 part |
| Hexanediol diacrylate | 0.4 part |
| [Aqueous solution of emulsifier] | |
| 15% aqueous solution of NEOGEN SC | 3 parts |
| Desalted water | 23 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 57,000, the average particle diameter determined by UPA was 56 nm and Tg was 84° C.

Particulate Colorant Dispersion 5

The same particulate colorant dispersion as particulate colorant dispersion 1 was used.

| Production of toner for development 5 | |
|---|---|
| Primary polymer particle dispersion 5 | 105 parts (71 gas solid content) |
| Particulate resin dispersion 5 | 5 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.53 part as solid content) was dropwise added to the mixed dispersion thus obtained with stirring. Thereafter, with stirring, the mixed dispersion obtained was heated to 50° C., which took 25 minutes, and the mixed dispersion was kept at that temperature for 1 hour, further heated to 63° C. for 35 minutes, where it was kept for 20 minutes. Thereafter, particulate charge control agent dispersion, particulate resin dispersion and aqueous aluminum sulfate (0.07 part as the solid content) were successively added, which were heated to 65° C. for 10 minutes. After keeping the resulting mixture for 30 minutes, 15% aqueous solution of NEOGEN SC (3 parts as solid content) was added thereto. The resulting mixture was heated to 96° C. for 30 minutes where the mixture was kept for 5 hours. Successively, the mixture obtained was cooled, filtered, washed with water, and then dried to obtain a toner (toner 5).

To 100 parts of the toner thus obtained was mixed 0.6 part of silica having been subjected to hydrophobic surface treatment with stirring to obtain a toner for development (toner for development 5).

Evaluation of Toner 5

Toner for development 5 obtained had a volume average particle diameter determined by COULTER COUNTER of 7.9 μm. In the resulting toner, the portion having a volume particle diameter of 5 μm or less was 2%. While the portion having a volume particle diameter of 15 μm or more was 1.5%. The ratio of the volume average particle diameter and the number average particle diameter was 1.20. 50% circular degree of the toner was 0.95.

The fixability of toner for development 5 was evaluated. As the result, at a fixing rate of 120 mm/s, the toner was fixed at a temperature of from 170° C. to 220° C., and at a fixing rate of 30 mm/s, the toner was fixed at a temperature of from 130° C. to 220° C. OHP transparency was 70%.

The charged amount of toner 5 was −9 μC/g and the charged amount of toner for development 5 was −15 μC/g. The blocking resistance was A.

Example 6

Wax Dispersion 6

A 68.33 amount of desalted water, 30 parts of 7:3 mixture of an ester mixture mainly comprising behenyl behenate (UNISTER M2222SL, produced by NOF Corporation.) and polyester wax (Mw: about 1,000) and 1.67 parts of sodium dodecylbenzene sulfonate (NEOGEN SC, produced by Daiichi Kogyo Seiyaku Co., Ltd., 66% of active component) were mixed, then the resulting mixture was emulsified at 90° C. by applying high pressure shearing to obtain a dispersion of particulate ester wax. An average particle diameter of the particulate ester wax obtained determined by LA-500 was 490 nm.

Primary Polymer Particle Dispersion 6

Into a reactor (volume 2 liter, inner diameter 120 mm) equipped with an agitator (full zone blade), a concentrating apparatus, a jacket through which thermostat-regulated water flows, and an apparatus for charging starting materials and auxiliaries were charged wax dispersion 28 parts, 15% aqueous solution of NEOGEN SC 1.2 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| [Monomers] | |
|---|---|
| Styrene | 79 parts |
| Butyl acrylate | 21 parts |
| Acrylic acid | 3 parts |
| Bromotrichloromethane | 0.5 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 117,000, the average particle diameter determined by UPA was 201 nm and Tg was 53° C.

Particulate Resin Dispersion 6

The same particulate resin dispersion as particulate resin dispersion 5 was used.

Particulate Colorant Dispersion 6

The same particulate colorant dispersion as particulate colorant dispersion 1 was used.

Particulate Charge Control Agent Dispersion 6

The same particulate charge control agent dispersion as particulate charge control agent dispersion 1 was used.

| Production of toner for development 6 | |
|---|---|
| Primary polymer particle dispersion 6 | 104 parts (as solid content) |
| Particulate resin dispersion 5 | 6 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.52 part as solid content) was dropwise added to the mixed dispersion thus obtained with stirring. Thereafter, with stirring, the mixed dispersion obtained was heated to 50°, which took 20 minutes, and the mixed dispersion was kept at that temperature for 1 hour, further heated to 66° C. for 40 minutes, where it was kept for 10 minutes. Thereafter, particulate charge control agent dispersion, particulate resin dispersion and aqueous aluminum sulfate (0.08 part as the solid content) were successively added, which were heated to 68° C. for 10 minutes. After keeping the resulting mixture for 30 minutes, 15% aqueous solution of NEOGEN SC (3 parts as solid content) was added thereto. The resulting mixture was heated to 96° C. for 20 minutes where the mixture was kept for 4.5 hours. Successively, the mixture obtained was cooled, filtered, washed with water, and then dried to obtain a toner (toner 6).

To 100 parts of the toner thus obtained was mixed 0.6 part of silica having been subjected to hydrophobic surface treatment with stirring to obtain a toner for development (toner for development 6).

Evaluation of Toner 6

The toner for development obtained had a volume average particle diameter determined by COULTER COUNTER of 8.2 $\mu$m. In the resulting toner, the portion having a volume particle diameter of 5 $\mu$m or less was 0.7%. While the portion having a volume particle diameter of 15 $\mu$m or more was 1.6%. The ratio of the volume average particle diameter and the number average particle diameter was 1.14. 50% circular degree of the toner was 0.95.

The fixability of toner for development 6 was evaluated. As the result, at a fixing rate of 120 mm/s, the toner was fixed at a temperature of from 170° C. to 220° C., and at a fixing rate of 30 mm/s, the toner was fixed at a temperature of from 120° C. to 200° C.

The charged amount of toner 6 was −3.5 $\mu$C/g and the charged amount of toner for development 6 was −21 $\mu$C/g.

Example 7

Wax Dispersion 7

A 68.33 amount of desalted water, 30 parts of an ester mixture mainly comprising behenyl behenate (UNISTER M2222SL, produced by NOF Corporation) and 1.67 parts of sodium dodecylbenzene sulfonate (NEOGEN SC, produced by Dai-ichi Kogyo Seiyaku Co., Ltd., 66% of active component) were mixed, then the resulting mixture was emulsified at 90° C. by applying high pressure shearing to obtain an ester wax dispersion. An average particle diameter of the ester wax obtained determined by LA-500 was 340 nm.

Primary Polymer Particle Dispersion 7

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 7 35 parts and desalted water 396 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| [Monomers] | |
|---|---|
| Styrene | 79 parts |
| Butyl acrylate | 21 parts |
| Acrylic acid | 3 parts |
| Octane thiol | 0.38 part |
| 2-mercaptoethanol | 0.01 part |
| Hexanediol diacrylate | 0.7 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 127,000, the average particle diameter determined by UPA was 201 nm and Tg was 55° C.

Particulate Resin Dispersion 7

Into a reactor (volume 2 liter, inner diameter 120 mm) equipped with an agitator (three backward blades), a concentrating apparatus, a jacket through which thermostat-regulated water flows, and an apparatus for charging starting materials and auxiliaries were charged 15% aqueous solution of NEOGEN SC 4.3 parts and desalted water 376 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 88 parts |
| Butyl acrylate | 12 parts |
| Acrylic acid | 3 parts |
| Bromotrichloromethane | 0.5 part |
| 2-mercaptoethanol | 0.01 part |
| Divinyl benzene | 0.4 part |
| [Aqueous solution of emulsifier] | |
| 15% aqueous solution of NEOGEN SC | 2.2 parts |
| Desalted water | 24 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 110,000, the average particle diameter determined by UPA was 121 nm and Tg was 86° C.

Particulate Colorant Dispersion 7

A 20 part amount of pigment red 48:2 (compound represented by the following formula (B)), 4 parts of polyoxyethylene alkylphenyl ether and 76 parts of desalted water were dispersed by means of a sand grinder mill to obtain a particulate colorant dispersion. The resulting dispersion had an average particle diameter determined by UPA of 201 nm.

(B)

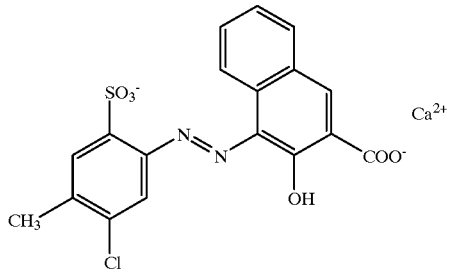

Particulate Charge Control Agent Dispersion 7

The same particulate charge control agent dispersion as particulate charge control agent dispersion 1 was used.

| Production of toner for development 7 | |
|---|---|
| Primary polymer particle dispersion 7 | 99 parts (as solid content) |
| Particulate resin dispersion 7 | 11 parts (as solid content) |
| Particulate colorant dispersion 7 | 6.7 parts (as solid content) |
| Particulate charge control agent dispersion 1 | 2 parts (as solid content) |
| Aqueous solution of 15% NEOGEN SC | 0.27 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.52 part as solid content) was added to the mixture dispersion thus obtained with stirring. Thereafter, with stirring, the mixed dispersion obtained was heated to 55° C., which took 30 minutes, and the mixed dispersion was kept at that temperature for 1 hour, further heated to 61° C. for 20 minutes, where it was kept for 15 minutes. Thereafter, particulate charge control agent dispersion, particulate resin dispersion and aqueous aluminum sulfate (0.08 part as the solid content) were successively added, which were heated to 63° C. for 10 minutes. After keeping the resulting mixture for 30 minutes, 15% aqueous solution of NEOGEN SC (3 parts as solid content) was added thereto. The resulting mixture was heated to 96° C. for 30 minutes where the mixture was kept for 1 hour. Successively, the mixture obtained was cooled, filtered, washed with water, and then dried to obtain a toner (toner 7).

To 100 parts of the toner thus obtained was mixed 0.6 part of silica having been subjected to hydrophobic surface treatment with stirring to obtain a toner for development (toner for development 7).

Evaluation of Toner 7

Toner for development 7 obtained had a volume average particle diameter determined by COULTER COUNTER of 7.8 $\mu$m. In the resulting toner, the portion having a volume particle diameter of 5 $\mu$m or less was 1.3%. While the portion having a volume particle diameter of 15 $\mu$m or more was 2.8%. The ratio of the volume average particle diameter and the number average particle diameter was 1.15. 50% circular degree of the toner was 0.98.

The fixability of toner for development 7 was evaluated. As the result, at a fixing rate of 120 mm/s, the toner was fixed at a temperature of from 160° C. to 210° C., and at a fixing rate of 30 mm/s, the toner was fixed at a temperature of from 120° C. to 190° C.

The charged amount of toner 7 was −15 $\mu$C/g and the charged amount of toner for development 7 was −28 $\mu$C/g.

Example 8

Wax Dispersion 8

The same wax dispersion as wax dispersion 7 was used.

Primary Polymer Particle Dispersion 8

The same primary polymer particle dispersion as primary polymer particle dispersion 7 was used.

Particulate Colorant Dispersion 8

The same particulate colorant dispersion as particulate colorant dispersion 7 was used.

Particulate Charge Control Agent Dispersion 8

The same particulate charge control agent dispersion as particulate charge control agent dispersion 1 was used.

| Production of toner for development 8 | |
|---|---|
| Primary polymer particle dispersion 7 | 110 parts (as solid content) |
| Particulate colorant dispersion 7 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and the resulting mixed dispersion was uniformly mixed. Aqueous aluminum sulfate (0.6 part as solid content) was dropwise added to the mixed dispersion thus obtained with stirring. Thereafter, with stirring, the mixed dispersion obtained was heated to 55° C., which took 30 minutes, and the mixed dispersion was kept at that temperature for 1 hour, further heated to 62° C. for 20 minutes, where it was kept for 10 minutes. Thereafter, particulate charge control agent dispersion was added, which were heated to 62° C. and kept at that temperature for 30 minutes. Then, 15% aqueous solution of NEOGEN SC (3 parts as solid content) was added thereto. The resulting mixture was heated to 96° C. for 35 minutes, which was kept for 1.5 hours. Successively, the mixture obtained was cooled, filtered, washed with water, and then dried to obtain a toner (toner 8).

To 100 parts of toner 8 thus obtained was mixed 0.6 part of silica having been subjected to hydrophobic surface treatment with stirring to obtain a toner for development (toner for development 8).

Evaluation of Toner 8

Toner for development 8 obtained had a volume average particle diameter determined by COULTER COUNTER of 7.3 μm. In the resulting toner, the portion having a volume particle diameter of 5 μm or less was 3.1%. While the portion having a volume particle diameter of 15 μm or more was 0.5%. The ratio of the volume average particle diameter and the number average particle diameter was 1.14. 50% circular degree of the toner was 0.98.

The fixability of toner for development 8 was evaluated. As the result, at a fixing rate of 120 mm/s, the toner was fixed at a temperature of from 150° C. to 220° C., and at a fixing rate of 30 mm/s, the toner was fixed at a temperature of from 110° C. to 180° C.

The charged amount of toner 8 was −3 μC/g and the charged amount of toner for development 8 was −14 μC/g.

Example 9

Wax Dispersion 9

The wax dispersion prepared according to the same manner as that of wax dispersion 7 was used. The average particle diameter of the same determined by LA-500 was 340 nm.

Primary Polymer Particle Dispersion 9

The primary polymer particle dispersion was prepared using the same formulation and procedure as those of primary polymer particle dispersion 7.

After the completion of the polymerization reaction, the resulting product was cooled to obtain an opaque white polymer dispersion. The weight average molecular weight of the soluble matter in THF of the polymer was 98,000, the average particle diameter determined by UPA was 188 nm and Tg was 57° C.

Particulate Resin Dispersion 9

The same particulate resin dispersion as particulate resin dispersion 7 was used.

Particulate Colorant Dispersion 9

The same particulate colorant dispersion as particulate colorant dispersion 1 was used.

Particulate Charge Control Agent Dispersion 9

The same particulate charge control agent dispersion as particulate charge control agent dispersion 1 was used.

| Production of toner for development 9 | |
|---|---|
| Primary polymer particle dispersion 9 | 99 parts (as solid content) |
| Particulate resin dispersion 7 | 11 parts (as solid content) |
| Particulate colorant dispersion 1 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and the resulting mixed dispersion was uniformly mixed. Aqueous aluminum sulfate (0.6 part as solid content) was dropwise added to the mixed dispersion thus obtained with stirring. Thereafter, with stirring, the mixed dispersion obtained was heated to 55° C., which took 20 minutes, and the mixed dispersion was kept at that temperature for 1 hour, further heated to 58° C. for 5 minutes, where it was kept for 1 hour. Thereafter, particulate charge control agent dispersion, particulate resin dispersion and aqueous aluminum sulfate (0.07 part as solid content) were successively added, which were heated to 65° C. for 25 minutes. Then, 15% aqueous solution of NEOGEN SC (4.1 parts as solid content) was added thereto. The resulting mixture was heated to 95° C. for 30 minutes, which was kept for 2 hours. Successively, the mixture obtained was cooled, filtered, washed with water, and then dried to obtain a toner (toner 9).

To 100 parts of toner 9 thus obtained was mixed 0.6 part of silica having been subjected to hydrophobic surface treatment with stirring to obtain a toner for development (toner for development 9).

Evaluation of Toner 9

The toner for development 9 obtained had a volume average particle diameter determined by COULTER COUNTER of 7.3 μm. In the resulting toner, the portion having a volume particle diameter of 5 μm or less was 1.4%. While the portion having a volume particle diameter of 15 μm or more was 0.3%. The ratio of the volume average particle diameter and the number average particle diameter was 1.11. 50% circular degree of the toner was 0.98.

The fixability of toner for development 9 was evaluated. As the result, at a fixing rate of 120 mm/s, the toner was fixed at a temperature of from 180° C. to 220° C., and at a fixing rate of 30 mm/s, the toner was fixed at a temperature of from 150° C. to 180° C.

The charged amount of toner 9 was −8 μC/g and the charged amount of toner for development 9 was −14 μC/g.

Example 10

Wax Dispersion 10

The same wax dispersion as wax dispersion 9 was used.

Primary Polymer Particle Dispersion 10

The same primary polymer particle dispersion as primary polymer particle dispersion 9 was used.

Particulate Resin Dispersion 10

The same particulate resin dispersion as particulate resin dispersion 7 was used.

Particulate Colorant Dispersion 10

The same particulate colorant dispersion as particulate colorant dispersion 3 was used.

Particulate Charge Control Agent Dispersion 10

The same particulate charge control agent dispersion as particulate charge control agent dispersion 1 was used.

| Production of toner for development 10 | |
|---|---|
| Primary polymer particle dispersion 9 | 99 parts (as solid content) |
| Particulate resin dispersion 9 | 11 parts (as solid content) |
| Particulate colorant dispersion 3 | 6.7 parts (as solid content) |
| Particulate charge control agent dispersion 1 | 2 parts (as solid content) |
| 15% aqueous solution of NEOGEN SC | 0.65 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added thereto and the resulting mixed dispersion was uniformly mixed. Aqueous aluminum sulfate (0.8 part as solid content) was dropwise added to the mixed dispersion thus obtained with stirring. Thereafter, with stirring, the mixed dispersion obtained was heated to 55° C., which took 25 minutes, and the mixed dispersion was kept at that temperature for 1 hour. Thereafter, particulate charge control agent dispersion was added, which were heated to 57° C. for 2 minutes. Then, particulate resin dispersion was added thereto, which were kept at 57° C. for 35 minutes. Successively, 15% aqueous solution of NEOGEN SC (4 parts as solid content) was added thereto. The resulting mixture was heated to 95° C. for 40 minutes, which was kept for 4 hours. Successively, the mixture obtained was cooled, filtered, washed with water, and then dried to obtain a toner (toner 10).

To 100 parts of toner 10 thus obtained was mixed 0.6 part of silica having been subjected to hydrophobic surface treatment with stirring to obtain a toner for development (toner for development).

Evaluation of Toner 10

The toner for development 10 obtained had a volume average particle diameter determined by COULTER COUNTER of 7.6 μm. In the resulting toner, the portion having a volume particle diameter of 5 μm or less was 1.6%. While the portion having a volume particle diameter of 15 μm or more was 2.4%. The ratio of the volume average particle diameter and the number average particle diameter was 1.15. 50% circular degree of the toner was 0.97.

The fixability of toner for development 10 was evaluated. As the result, at a fixing rate of 120 mm/s, the toner was fixed at a temperature of from 200° C. to 220° C., and at a fixing rate of 30 mm/s, the toner was fixed at a temperature of from 160° C. to 190° C.

The charged amount of toner 10 was −20 μC/g and the charged amount of toner for development 10 was −25 μC/g.

Comparative Example 11

Example wherein both primary polymer particle and particulate resin do not comprise wax.

Wax Dispersion 11

Primary Polymer Particle Dispersion 11

Into a reactor (volume 60 liter, inner diameter 400 mm) equipped with an agitator (three blades), a concentrating apparatus, a jacket through which thermostat-regulated water flows, and an apparatus for charging starting materials and auxiliaries were charged 2 parts of 15% aqueous solution of NEOGEN SC and 378 parts of desalted water, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| [Monomers] | |
|---|---|
| Styrene | 79 parts |
| Butyl acrylate | 21 parts |
| Acrylic acid | 3 parts |
| Bromotrichloromethane | 0.45 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 126,000, the average particle diameter determined by UPA was 199 nm and Tg was 70° C.

Particulate Resin Dispersion 11

The same particulate resin dispersion as particulate resin dispersion 1 was used.

Particulate Colorant Dispersion 11

The same particulate colorant dispersion as particulate colorant dispersion 1 was used.

Particulate Charge Control Agent Dispersion 11

The same particulate charge control agent dispersion as particulate charge control agent dispersion 1 was used.

| Production of toner for development 11 | |
|---|---|
| Primary polymer particle dispersion 11 | 95 parts (as solid content) |
| Particulate resin dispersion 1 | 5 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN SC | 0.2 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.54 part as solid content) was dropwise added to the mixture dispersion thus obtained with stirring. Thereafter, with stirring, the mixed dispersion obtained was heated to 50° C., which took 25 minutes, and the mixed dispersion was kept at that temperature for 1 hour, further heated to 69° C. for 1 hour, where it was kept for 10 minutes. Thereafter, particulate charge control agent dispersion, particulate resin dispersion and aqueous aluminum sulfate (0.06 part as the solid content) were successively added, which were heated to 71° C. for 10 minutes. After keeping the resulting mixture for 30 minutes, 15% aqueous solution of NEOGEN SC (3.3 parts as solid content) was added thereto. The resulting mixture was heated to 96° C. for 25 minutes where the mixture was kept for 7 hours. Successively, the mixture obtained was cooled, filtered, washed with water, and then dried to obtain a toner (toner 11).

To 100 parts of the toner thus obtained was mixed 0.6 part of silica having been subjected to hydrophobic surface treatment with stirring to obtain a toner for development (toner for development 11).

Evaluation of Toner 11

The toner for development obtained had a volume average particle diameter determined by COULTER COUNTER of 7.5 $\mu$m. In the resulting toner, the portion having a volume particle diameter of 5 $\mu$m or less was 2.5%. While the portion having a volume particle diameter of 15 $\mu$m or more was 1.1%. The ratio of the volume average particle diameter and the number average particle diameter was 1.14. 50% circular degree of the toner was 0.93.

The fixability of toner for development 11 was evaluated. As the result, at a fixing rate of 120 mm/s, the toner was fixed at a temperature of from 180° C. to 190° C., and at a fixing rate of 30 mm/s, the toner was fixed at a temperature of from 140° C. to 160° C.

The charged amount of toner 11 was −27 $\mu$C/g and the charged amount of toner for development 11 was −58 $\mu$C/g.

Example 12

Wax Dispersion 12

Dispersion prepared as in wax dispersion 1 was used. An average particle diameter of the particulate wax obtained determined by LP-500 was 340 nm.

Primary Polymer Particle Dispersion 12

Into a reactor (volume 3 liter, inner diameter 150 mm) equipped with an agitator (three backward blades), a concentrating apparatus, a jacket through which thermostat-regualated water flows, and an apparatus for charging starting materials and auxiliaries were charged wax dispersion 12 35 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| [Monomers] | |
|---|---|
| Styrene | 79 parts |
| Butyl acrylate | 21 parts |
| Acrylic acid | 3 parts |
| Bromotrichloromethane | 0.45 part |
| 2-mercaptoethanol | 0.01 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 62,000, the average particle diameter determined by UPA was 213 nm and Tg was 53° C.

Particulate Resin Dispersion 12

The same particulate resin dispersion as particulate resin dispersion 1 was used.

Particulate Colorant Dispersion 12

The same particulate colorant dispersion as particulate colorant dispersion 1 was used.

Particulate Charge Control Agent Dispersion 12

The same particulate charge control agent dispersion as particulate charge control agent dispersion 1 was used.

| Production of toner for development 12 | |
|---|---|
| Primary polymer particle dispersion 12 | 88 parts (as solid content) |
| Particulate resin dispersion 1 | 22 parts (as solid content) |
| Particulate colorant dispersion 2 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Further, particulate colorant dispersion was added and also uniformly mixed. Aqueous aluminum sulfate (0.5 part as solid content) was dropwise added to the mixture dispersion thus obtained with stirring. Thereafter, with keeping stirring, the mixed dispersion obtained was heated to 50° C., which took 25 minutes, and the mixed dispersion was kept at that temperature for 1 hour, further heated to 60° C. for 40 minutes, where it was kept for 10 minutes. Thereafter, particulate charge control agent dispersion, particulate resin dispersion and aqueous aluminum sulfate (0.1 part as the solid content) were successively added, which were heated to 63° C. for 10 minutes. After keeping the resulting mixture for 30 minutes, 15% aqueous solution of NEOGEN SC (3 parts as solid content) was added thereto. The resulting mixture was heated to 96° C. for 25 minutes where the mixture was kept for 1 hour. Successively, the mixture obtained was cooled, filtered, washed with water, and then dried to obtain a toner (toner 12).

To 100 parts of toner 12 thus obtained was mixed 0.6 part of silica having been subjected to hydrophobic surface treatment with stirring to obtain a toner for development (toner for development 12).

Evaluation of Toner 12

Toner for development 12 obtained had a volume average particle diameter determined by COULTER COUNTER of 9.8 μm. In the resulting toner, the portion having a volume particle diameter of 5 μm or less was 0.3%. While the portion having a volume particle diameter of 15 μm or more was 3.3%. The ratio of the volume average particle diameter and the number average particle diameter was 1.17. 50% circular degree of the toner was 0.99.

The fixability of toner for development 12 was evaluated. As the result, at a fixing rate of 120 mm/s, the toner was fixed at a temperature of from 170° C. to 180° C., and at a fixing rate of 30 mm/s, the toner was fixed at a temperature of 140° C.

The charged amount of toner 12 was −19 μC/g and the charged amount of toner for development 12 was −12 μC/g.

Example 13

Wax Dispersion 13

A 68.33 part amount of desalted water, 30 parts of glyceride montanoate and 5 parts of polyoxyethylene nonylphenyl ether were mixed, then the resulting mixture was emulsified at 90° C. by applying high pressure shearing to obtain a dispersion of particulate ester wax. An average particle diameter of the particulate ester wax obtained determined by LA-500 was 900 nm. (primary polymer particle dispersion 13).

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 13 35 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.5 part |
| 2-mercaptoethanol | 0.01 part |
| Divinyl benzene | 0.2 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 10.5 parts |
| 8% aqueous ascorbic acid | 10.5 parts |

After the completion of the polymerization reaction, the resulting product was cooled to obtain an opaque white polymer dispersion. The weight average molecular weight of the soluble matter in THF of the polymer was 160,000, the average particle diameter determined by UPA was 280 nm and Tg was 55° C.

Particulate Colorant Dispersion 13

The same particulate colorant dispersion as particulate colorant 1 was used.

Particulate Charge Control Agent Dispersion 13

A 5 part amount of BRONTON E-82, 4 parts of alkylnaphthalene sulfonate and 76 parts of desalted water were dispersed by mean of a sand grinder mill to obtain a particulate charge control agent dispersion. An average particle diameter of the same determined by UPA was 200 nm.

| Production of toner for development 13 | |
|---|---|
| Primary polymer particle dispersion 13 | 120 parts (as solid content) |
| Particulate colorant dispersion 1 | 7 parts (as solid content) |
| Particulate charge control agent dispersion 13 | 5 parts (as solid content) |
| Aqueous solution of 15% NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.5 part as solid content) was dropwise added to the mixture dispersion thus obtained with stirring. Thereafter, while stirring the resulting mixed dispersion, the dispersion was heated to 50° C., which took 25 minutes, and the mixed dispersion was kept at that temperature for 1 hour, further heated to 61° C. for 40 minutes, where it was kept for 10 minutes. Thereafter, particulate charge control agent dispersion, particulate resin dispersion and aqueous aluminum sulfate (0.1 part as the solid content) were successively added, which were heated to 63° C. for 10 minutes. After keeping the resulting mixture for 30 minutes, 15% aqueous solution of NEOGEN SC (3 parts as solid content) was added thereto. The resulting mixture was heated to 96° C. for 25 minutes where the mixture was kept for 1 hour. Successively, the mixture obtained was cooled, filtered, washed with water, and then dried to obtain a toner (toner 13).

To 100 parts of the toner thus obtained was mixed 0.6 part of silica having been subjected to hydrophobic surface treatment with stirring to obtain a toner for development (toner for development 13).

Evaluation of Toner 13

Toner for development 13 obtained had a volume average particle diameter determined by COULTER COUNTER of 8.8 μm. In the resulting toner, the portion having a volume particle diameter of 5 μm or less was 0.2%. While the portion having a volume particle diameter of 15 μm or more was 0.5%. The ratio of the volume average particle diameter and the number average particle diameter was 1.11. 50% circular degree of the toner was 0.96.

The fixability of toner for development 13 was evaluated. As the result, at a fixing rate of 120 mm/s and Nip of 4 mm, the toner was fixed at a temperature of from 140° C. to 220° C., and at a fixing rate of 30 mm/s and Nip of 31 mm, the toner was fixed at a temperature of from 110° C. to 220° C.

The charged amount of toner 13 was −5 μC/g and the charged amount of toner for development 13 was −17 μC/g.

Example 14

Wax Dispersion 14

A 68.33 part amount of desalted water, 30 parts of 50:50 mixture of glyceride montanoate and behenyl behenate (UNISTER M2222SL, produced by NOF Corporation), and 5 parts of polyoxyethylenenonylphenyl ether were mixed, then the resulting mixture was emulsified at 90° C. by applying high pressure shearing to obtain a dispersion of particulate ester wax. An average particle diameter of the particulate ester wax obtained determined by LA-500 was 900 nm.

Primary Polymer Particle Dispersion 14

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 14 35 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| [Monomers] | |
|---|---|
| Styrene | 79 parts |
| Butyl acrylate | 21 parts |
| Acrylic acid | 3 parts |
| Bromotrichloromethane | 0.5 part |
| 2-mercaptoethanol | 0.01 part |
| Divinyl benzene | 0.2 part |

-continued

| [Aqueous solution of emulsifier] | |
|---|---|
| 15% aqueous solution of NEOGEN SC | 1 part |
| Desalted water | 25 parts |
| [Aqueous polymerization initiator] | |
| 8% aqueous hydrogen peroxide | 10.5 parts |
| 8% aqueous ascorbic acid | 10.5 parts |

After the completion of the polymerization reaction, the resulting product was cooled to obtain an opaque white polymer dispersion. The weight average molecular weight of the soluble matter in THF of the polymer was 160,000, the average particle diameter determined by UPA was 280 nm and Tg was 55° C.

Particulate Colorant Dispersion 14

The same particulate colorant dispersion as particulate colorant dispersion 1 was used.

Particulate Charge Control Agent Dispersion 14

The same articulate charge control agent dispersion as particulate charge control agent dispersion 13 was used.

| Production of toner for development 14 | |
|---|---|
| Primary polymer particle dispersion 14 | 120 parts (as solid content) |
| Particulate colorant dispersion 1 | 7 parts (as solid content) |
| Particulate charge control agent dispersion 13 | 5 parts (as solid content) |
| Aqueous solution of 15% NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. Aqueous aluminum sulfate (0.5 part as solid content) was dropwise added to the mixture dispersion thus obtained with stirring. Thereafter, with continuing stirring, the mixed dispersion obtained was heated to 50° C., which took 25 minutes, and the mixed dispersion was kept at that temperature for 1 hour, further heated to 61° C. for 40 minutes, where it was kept for 10 minutes. Thereafter, particulate charge control agent dispersion, particulate resin dispersion and aqueous aluminum sulfate (0.1 part as the solid content) were successively added, which were heated to 63° C. for 10 minutes. After keeping the resulting mixture for 30 minutes, 15% aqueous solution of NEOGEN SC (3 parts as solid content) was added thereto. The resulting mixture was heated to 96° C. for 25 minutes where the mixture was kept for 1 hour. Successively, the mixture obtained was cooled, filtered, washed with water, and then dried to obtain a toner (toner 14).

To 100 parts of the toner thus obtained was mixed 0.6 part of silica having been subjected to hydrophobic surface treatment with stirring to obtain a toner for development (toner for development 14).

Evaluation of Toner 14

The toner for development obtained had a volume average particle diameter determined by COULTER COUNTER of 8.8 μm. In the resulting toner, the portion having a volume particle diameter of 5 μm or less was 0.2%. While the portion having a volume particle diameter of 15 μm or more was 0.3%. The ratio of the volume average particle diameter and the number average particle diameter was 1.11. 50% circular degree of the toner was 0.96.

The fixability of toner for development 14 was evaluated. As the result, at a fixing rate of 120 mm/s and Nip of 4 mm, the toner was fixed at a temperature of from 140° C. to 220° C., and at a fixing rate of 120 mm/s and Nip of 31 mm, the toner was fixed at a temperature of from 110° C. to 220° C. The charged amount of toner 14 was −3 μC/g and the charged amount of toner for development 14 was −15 μC/g.

Example 15

Wax Dispersion 15

Dispersion prepared as in wax dispersion 7 was used. An average particle diameter of the wax obtained determined by LA-500 was 340 nm.

Primary Polymer Particle Dispersion 15

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 15 35 parts and desalted water 396 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Octane thiol | 0.38 part |
| 2-mercaptoethanol | 0.01 part |
| Hexanediol diacrylate | 0.7 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 10.6 parts |
| 8% aqueous ascorbic acid | 10.6 parts |

After the completion of the polymerization reaction, the resulting product was cooled to obtain an opaque white polymer dispersion. The weight average molecular weight of the soluble matter in THF of the polymer was 98,000, the average particle diameter determined by UPA was 190 nm and Tg was 57° C.

Particulate Resin Dispersion 15

Into a reactor (volume 2 liter, inner diameter 120 mm) equipped with an agitator (three backward blades), a concentrating apparatus, a jacket through which thermostat-regulated water flows, and an apparatus for charging starting materials and auxiliaries were charged 15% aqueous solution of NEOGEN SC 4.3 parts and desalted water 376 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Trichlorobromomethane | 0.5 part |
| 2-mercaptoethanol | 0.01 part |
| [Aqueous solution of emulsifier] | |
| 15% aqueous solution of NEOGEN SC | 2.2 parts |
| Desalted water | 25 parts |
| [Aqueous polymerization initiator] | |
| 8% aqueous hydrogen peroxide | 10.6 parts |
| 8% aqueous ascorbic acid | 10.6 parts |

After the completion of the polymerization reaction, the resulting product was cooled to obtain an opaque white polymer dispersion. The weight average molecular weight of the soluble matter in THF of the polymer was 60,000, the average particle diameter determined by UPA was 154 nm and Tg was 65° C.

Particulate Colorant Dispersion 15

The same particulate colorant dispersion as particulate colorant dispersion 1 was used.

Particulate Charge Control Agent Dispersion 15

The same particulate charge control agent dispersion as particulate charge control agent dispersion 1 was used.

| Production of toner for development 15 | |
|---|---|
| Primary polymer particle dispersion 15 | 90 parts (as solid content) |
| Particulate resin dispersion 15 | 10 parts (as solid content) |
| Particulate colorant dispersion 1 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Then particulate colorant dispersion was added thereto, which were also uniformly mixed. Aqueous aluminum sulfate (0.6 part as solid content) was dropwise added to the mixed dispersion thus obtained with stirring. Thereafter, with stirring, the mixed dispersion obtained was heated to 55° C., which took 20 minutes, and the mixed dispersion was kept at that temperature for 1 hour, further heated to 58° C. for 5 minutes, where it was kept for 1 hour. Thereafter, particulate charge control agent dispersion, particulate resin dispersion and aqueous aluminum sulfate (0.07 part as the solid content) were successively added, which were heated to 65° C. for 25 minutes. Then, 15% aqueous solution of NEOGEN SC (3 parts as solid content) was added thereto. The resulting mixture was heated to 95° C. for 30 minutes where the mixture was kept for 4 hours. Successively, the mixture obtained was cooled, filtered, washed with water, and then dried to obtain a toner (toner 15).

To 100 parts of toner 15 thus obtained was mixed 0.6 part of silica having been subjected to hydrophobic surface treatment with stirring to obtain a toner for development (toner for development 15).

Evaluation of Toner 15

The toner for development obtained had a volume average particle diameter determined by COULTER COUNTER of 7.4 μm. In the resulting toner, the portion having a volume particle diameter of 5 μm or less was 1.7%. While the portion having a volume particle diameter of 15 μm or more was 0.3%. The ratio of the volume average particle diameter and the number average particle diameter was 1.09. 50% circular degree of the toner was 0.98.

The fixability of toner for development 15 was evaluated. As the result, at a fixing rate of 120 mm/s, the toner was fixed at a temperature of from 180° C. to 220° C., and at a fixing rate of 30 mm/s, the toner was fixed at a temperature of from 150° C. to 180° C.

The charged amount of toner 15 was −18 μC/g and the charged amount of toner for development 15 was −18 μC/g.

Example 16

Wax Dispersion 16

The same dispersion as wax dispersion 14 was used.

Primary Polymer Particle Dispersion 16

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 14 35 parts and desalted water 396 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Octane thiol | 0.38 part |
| 2-mercaptoethanol | 0.01 part |

-continued

| | |
|---|---|
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 10.6 parts |
| 8% aqueous ascorbic acid | 10.6 parts |

After the completion of the polymerization reaction, the resulting product was cooled to obtain an opaque white polymer dispersion. The weight average molecular weight of the soluble matter in THF of the polymer was 45,000, the average particle diameter determined by UPA was 200 nm and Tg was 57° C.

Particulate Resin Dispersion 16

Into a reactor (volume 2 liter, inner diameter 120 mm) equipped with an agitator (three backward blades), a heating condenser, a concentrating apparatus and an apparatus for charging starting materials and auxiliaries were charged 15% aqueous solution of NEOGEN SC 4.3 parts and desalted water 376 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| bromotrichloromethane | 0.5 part |
| 2-mercaptoethanol | 0.01 part |
| Divinyl benzene | 0.4 part |
| [Aqueous solution of emulsifier] | |
| 15% aqueous solution of NEOGEN SC | 2.2 parts |
| Desalted water | 25 parts |
| [Aqueous polymerization initiator] | |
| 8% aqueous hydrogen peroxide | 10.6 parts |
| 8% aqueous ascorbic acid | 10.6 parts |

After the completion of the polymerization reaction, the resulting product was cooled to obtain an opaque white polymer dispersion. The weight average molecular weight of the soluble matter in THF of the polymer was 98,000, the average particle diameter determined by UPA was 150 nm and Tg was 65° C.

Particulate Colorant Dispersion 16

The same particulate colorant dispersion as particulate colorant dispersion 1 was used.

Particulate Charge Control Agent Dispersion 16

The same particulate charge control agent dispersion as particulate charge control agent dispersion 1 was used.

| Production of toner for development 16 | |
|---|---|
| Primary polymer particle dispersion 16 | 90 parts (as solid content) |
| Particulate resin dispersion 16 | 10 parts (as solid content) |
| Particulate colorant dispersion 1 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Then particulate colorant dispersion was added thereto, which were also uniformly mixed. Aqueous aluminum sulfate (0.6 part as solid content) was dropwise added to the mixture dispersion thus obtained with stirring. Thereafter, with stirring, the mixed dispersion obtained was heated to 55° C., which took 20 minutes, and the mixed dispersion was kept at that temperature for 1 hour, further heated to 58° C. for 5 minutes, where it was kept for 1 hour. Thereafter, particulate charge control agent dispersion, particulate resin dispersion and aqueous aluminum sulfate (0.1 part as the solid content) were successively added, which were kept for 1.5 hours. Thereafter, the mixture obtained was heated to 65° C. for 25 minutes. Then, 15% aqueous solution of NEOGEN SC (3 parts as solid content) was added thereto. The resulting mixture was heated to 95° C. for 30 minutes where the mixture was kept for 4 hours. Successively, the mixture obtained was cooled, filtered, washed with water, and then dried to obtain a toner (toner 16).

To 100 parts of toner 16 thus obtained was mixed 0.6 part of silica having been subjected to hydrophobic surface treatment with stirring to obtain a toner for development (toner for development 16).

Evaluation of Toner 16

The toner for development obtained had a volume average particle diameter determined by COULTER COUNTER of 7.5 $\mu$m. In the resulting toner, the portion having a volume particle diameter of 5 $\mu$m or less was 1.6%. While the portion having a volume particle diameter of 15 $\mu$m or more was 0.2%. The ratio of the volume average particle diameter and the number average particle diameter was 1.1. 50% circular degree of the toner was 0.98.

The fixability of toner for development 16 was evaluated. As the result, at a fixing rate of 120 mm/s, the toner was fixed at a temperature of from 180° C. to 220° C., and at a fixing rate of 30 mm/s, the toner was fixed at a temperature of from 150° C. to 180° C.

The charged amount of toner 16 was −10 $\mu$C/g and the charged amount of toner for development 16 was −20 $\mu$C/g.

Example 17

Wax Dispersion 17

A 68.33 part amount of desalted water, 30 parts of 50:50 mixture of glyceride montanoate and behenyl behenate, and 4 parts of polyoxyethylenenonylphenyl ether were mixed, then the resulting mixture was emulsified at 90° C. by applying high pressure shearing to obtain a dispersion of ester wax. An average particle diameter of the ester wax obtained determined by LA-500 was 700 nm.

Primary Polymer Particle Dispersion 17

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 17 35 parts and desalted water 396 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| [Monomers] | |
|---|---|
| Styrene | 79 parts |
| Butyl acrylate | 21 parts |
| Acrylic acid | 3 parts |
| Bromotrichloromethane | 1 part |
| 2-mercaptoethanol | 0.01 part |
| Divinylbenzene | 0.2 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 10.5 parts |
| 8% aqueous ascorbic acid | 10.5 parts |

After the completion of the polymerization reaction, the resulting product was cooled to obtain an opaque white polymer dispersion. The weight average molecular weight of the soluble matter in THF of the polymer was 160,000, the average particle diameter determined by UPA was 280 nm and Tg was 55° C.

Particulate Colorant Dispersion 17

The same particulate colorant dispersion as particulate colorant dispersion 1 was used.

Particulate Charge Control Agent Dispersion 17

The same particulate charge control agent dispersion as particulate charge control agent dispersion 13 was used.

| Production of toner for development 17 | |
|---|---|
| Primary polymer particle dispersion 17 | 120 parts (as solid content) |
| Particulate colorant dispersion 1 | 7 parts (as solid content) |
| Particulate charge control agent dispersion 13 | 5 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Then particulate colorant dispersion was added thereto, which were also uniformly mixed. Aqueous aluminum sulfate (0.5 part as solid content) was dropwise added to the mixture dispersion thus obtained with stirring. Thereafter, with stirring, the mixed dispersion obtained was heated to 50° C., which took 25 minutes, and the mixed dispersion was kept at that temperature for 1 hour, further heated to 61° C. for 40 minutes, where it was kept for 10 minutes. Thereafter, particulate charge control agent dispersion, particulate resin dispersion and aqueous aluminum sulfate (0.1 part as the solid content) were successively added, which were heated to 63° C. for 10 minutes where it was kept for 30 minutes. Then, 15% aqueous solution of NEOGEN SC (3 parts as solid content) was added thereto. The resulting mixture was heated to 96° C. for 25 minutes where the mixture was kept for 1 hour. Successively, the mixture obtained was cooled, filtered, washed with water, and then dried to obtain a toner (toner 17).

To 100 parts of toner 17 thus obtained was mixed 0.6 part of silica having been subjected to hydrophobic surface treatment with stirring to obtain a toner for development (toner for development 17).

Evaluation of Toner 17

Toner for development 17 obtained had a volume average particle diameter determined by COULTER COUNTER of 7.8 μm. In the resulting toner, the portion having a volume particle diameter of 5 μm or less was 1.5%. While the portion having a volume particle diameter of 15 μm or more was 0.5%. The ratio of the volume average particle diameter and the number average particle diameter was 1.17. 50% circular degree of the toner was 0.99.

The fixability of toner for development 17 was evaluated. As the result, at a fixing rate of 120 mm/s and Nip of 4 mm, the toner was fixed at a temperature of from 150° C. to 220° C., and at a fixing rate of 120 mm/s and Nip of 31 mm, the toner was fixed at a temperature of from 120° C. to 220° C.

The charged amount of toner 17 was −3 μC/g and the charged amount of toner for development 17 was −11 μC/g.

Example 18

Wax Dispersion 18

A 68.33 part amount of desalted water, 30 parts of an ester mixture mainly comprising behenyl behenate (UNISTER M2222SL, produced by NOF Corporation)) and 4 parts of polyoxyethylenenonylphenyl ether were mixed, then the resulting mixture was emulsified at 90° C. by applying high pressure shearing to obtain a dispersion of ester wax. An average particle diameter of the ester wax obtained determined by LA-500 was 900 nm.

Primary Polymer Particle Dispersion 18

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 18 35 parts and desalted water 396 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.5 part |
| 2-mercaptoethanol | 0.01 part |
| Divinyl benzene | 0.2 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 10.5 parts |
| 8% aqueous ascorbic acid | 10.5 parts |

After the completion of the polymerization reaction, the resulting product was cooled to obtain an opaque white polymer dispersion. The weight average molecular weight of the soluble matter in THF of the polymer was 243,000, the average particle diameter determined by UPA was 263 nm and Tg was 55° C.

Particulate Colorant Dispersion 18

The same particulate colorant dispersion as particulate colorant dispersion 1 was used.

Particulate Charge Control Agent Dispersion 18

The same particulate charge control agent dispersion as particulate charge control agent dispersion 1 was used.

| Production of toner for development 18 | |
|---|---|
| Primary polymer particle dispersion 18 | 120 parts (as solid content) |
| Particulate colorant dispersion 1 | 7 parts (as solid content) |
| Particulate charge control agent dispersion 1 | 5 parts (as solid content) |
| Aqueous solution of 15% NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and aqueous solution of 15% NEOGEN SC, which were uniformly mixed. Then particulate colorant dispersion was added to the resulting mixture, which were also uniformly mixed. 10 wt % aqueous NaCl (3 parts as solid content) was dropwise added to the mixture dispersion thus obtained with stirring. Thereafter, with continuing stirring, the mixed dispersion obtained was heated to 50° C., which took 25 minutes, and the mixed dispersion was kept at that temperature for 1 hour, further heated to 61° C. for 40 minutes, where it was kept for 10 minutes. Thereafter, particulate charge control agent dispersion, particulate resin dispersion and 10 wt % aqueous NaCl (0.5 part as the solid content) were successively added, which were heated to 63° C. for 10 minutes. After keeping the resulting mixture for 30 minutes, 15% aqueous solution of NEOGEN SC (3 parts as solid content) was added thereto. The resulting mixture was heated to 96° C. for 25 minutes where the mixture was kept for 1 hour. Successively, the mixture obtained was cooled, filtered, washed with water, and then dried to obtain a toner (toner 18).

To 100 parts of the toner thus obtained was mixed 0.6 part of silica having been subjected to hydrophobic surface treatment with stirring to obtain a toner for development (toner for development 18).

Evaluation of Toner 18

The toner for development obtained had a volume average particle diameter determined by COULTER COUNTER of 7.4 μm. In the resulting toner, the portion having a volume particle diameter of 5 μm or less was 7.2%. While the portion having a volume particle diameter of 15 μm or more was 4.6%. The ratio of the volume average particle diameter and the number average particle diameter was 1.12. 50% circular degree of the toner was 0.99.

The fixability of toner for development 18 was evaluated. As the result, at a fixing rate of 120 mm/s and Nip of 4 mm, the toner was fixed at a temperature of from 140° C. to 220° C., and at a fixing rate of 120 mm/s and Nip of 31 mm, the toner was fixed at a temperature of from 110° C. to 220° C.

The charged amount of toner 18 was −10 μC/g and the charged amount of toner for development 18 was −14 μC/g.

Example 19

Wax Dispersion 19

The same wax dispersion as wax dispersion 5 was used.

Primary Polymer Particle Dispersion 19

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged 15% aqueous NEOGEN SC 2 parts and desalted water 378 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Bromotrichloromethane | 0.5 part |
| 2-mercaptoethanol | 0.01 part |
| Hexanediol diacrylate | 0.9 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 104,000, the average particle diameter determined by UPA was 207 nm and Tg was 71° C.

Particulate Colorant Dispersion 19

The same particulate colorant dispersion as particulate colorant dispersion 1 was used.

Particulate Charge Control Agent Dispersion 19

The same particulate charge control agent dispersion as particulate charge control agent dispersion 1 was used.

| Production of toner for development 19 | |
|---|---|
| Primary polymer particle dispersion 19 | 100 parts (as solid content) |
| Wax dispersion 5 | 10 parts (as solid content) |
| Particulate resin dispersion | 10 parts (as solid content) |
| Particulate colorant dispersion 1 | 6.7 parts (as solid content) |
| Particulate charge control agent dispersion 1 | 2 parts (as solid content) |
| 15% aqueous solution of NEOGEN SC | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Then particulate colorant dispersion was added thereto, which were also uniformly mixed. Aqueous aluminum sulfate (0.6 part as solid content) was dropwise added to the mixture dispersion thus obtained with stirring. Thereafter, with stirring, the mixed dispersion obtained was heated to 61° C., which took 90 minutes, and the mixed dispersion was kept at that temperature for 1 hour, further heated to 67° C. for 30 minutes, where it was kept for 1 hour. Thereafter, particulate charge control agent dispersion was added, which were kept for 30 minutes. Then, 15% aqueous solution of NEOGEN SC (3 parts as solid content) was added thereto. The resulting mixture was heated to 96° C. for 30 minutes where the mixture was kept for 2 hours. Successively, the mixture obtained was cooled, filtered, washed with water, and then dried to obtain a toner (toner 19).

To 100 parts of toner 19 thus obtained was mixed 0.6 part of silica having been subjected to hydrophobic surface treatment with stirring to obtain a toner for development (toner for development 19).

Evaluation of Toner 19

Toner for development 19 obtained had a volume average particle diameter determined by COULTER COUNTER of 6.6 μm. In the resulting toner, the portion having a volume particle diameter of 5 μm or less was 9.0%. While the portion having a volume particle diameter of 15 μm or more was 4.4%. The ratio of the volume average particle diameter and the number average particle diameter was 1.24. 50% circular degree of the toner was 0.98.

The fixability of toner for development 19 was evaluated. As the result, at a fixing rate of 120 mm/s, the toner was fixed at a temperature of from 180° C. to 220° C., and at a fixing rate of 30 mm/s, the toner was fixed at a temperature of from 150° C. to 180° C.

The charged amount of toner 19 was −8 μC/g and the charged amount of toner for development 19 was −14 μC/g.

Comparative Example 20

Wax Dispersion 20

The same wax dispersion as wax dispersion 7 was used.

Primary Polymer Particle Dispersion 20

Into a reactor (volume 60 liter, inner diameter 400 mm) equipped with an agitator (three blades), a concentrating apparatus, a jacket through which thermostat-regulated water flows, and an apparatus for charging starting materials and auxiliaries were charged 35 parts of wax dispersion 7, 1.2 part of 15% aqueous solution of NEOGEN SC and 393 parts of desalted water, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueouw polymerization initiator was added for 6 hours from the initiation of polymerization. The resulting reaction mixture was further kept for 30 minutes.

| | |
|---|---|
| [Monomers] | |
| Styrene (5530 g) | 79 parts |
| Butyl acrylate | 21 parts |
| Acrylic acid | 3 parts |
| Octene thiol | 0.38 part |
| 2-mercaptoethanol | 0.01 part |
| [Aqueous solution of emulsifier] | |
| 15% aqueous solution of NEOGEN SC | 1 part |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 72,700, the average particle diameter determined by UPA was 202 nm and Tg was 57° C.

Particulate Colorant Dispersion 20

The same particulate colorant dispersion as particulate colorant dispersion 1 was used.

Particulate Charge Control Agent Dispersion 20

The same particulate charge control agent dispersion as particulate charge control agent dispersion 1 was used.

| Production of toner for development 20 | |
|---|---|
| Primary polymer particle dispersion 20 | 110 parts (as solid content) (21.25 kg) |
| Particulate colorant dispersion 1 | 6.7 parts (as solid content) |
| Particulate charge control agent dispersion 1 | 2 parts (as solid content) |
| Aqueous solution of 15% NEOGEN SC | 0.65 part (as solid content) |

By using the above-described respective components, toner was produced according to the following manner.

To a reactor (volume 60 liter, an anchor blade equipped with a baffle) were charged primary polymer particle dispersion and 15% aqueous solution of NEOGEN SC, which were uniformly mixed. Then particulate colorant dispersion was added to the resulting mixture, which were also uniformly mixed. Aqueous aluminum sulfate (0.6 part as solid content) was dropwise added to the mixture dispersion thus obtained with stirring. Thereafter, with stirring, the mixed dispersion obtained was heated to 55° C., which took 100 minutes, and the mixed dispersion was kept at that temperature for 1 hour, further heated to 58° C. for 10 minutes, where it was kept for 40 minutes. Thereafter, particulate charge control agent dispersion and 15% aqueous solution of NEOGEN SC (3 parts as solid content) were added thereto. The resulting mixture was heated to 95° C. for 60 minutes where the mixture was kept for 2 hours. Successively, the mixture obtained was cooled, filtered, washed with water, and then dried to obtain a toner (toner 20).

To 100 parts of the toner thus obtained was mixed 0.6 part of silica having been subjected to hydrophobic surface treatment with stirring to obtain a toner for development (toner for development 20).

Evaluation of Toner 20

Toner for development 20 obtained had a volume average particle diameter determined by COULTER COUNTER of 8.5 $\mu$m. In the resulting toner, the portion having a volume particle diameter of 5 $\mu$m or less was 5.4%. While the portion having a volume particle diameter of 15 $\mu$m or more was 14.5%. The ratio of the volume average particle diameter and the number average particle diameter was 1.42. 50% circular degree of the toner was 0.99.

The fixability of toner for development 20 was evaluated. As the result, at a fixing rate of 120 mm/s, the toner was fixed at a temperature of from 180° C. to 190° C., and at a fixing rate of 30 mm/s, the toner was fixed at a temperature of from 130° C. to 180° C.

The charged amount of toner 20 was +2 $\mu$C/g and the charged amount of toner for development 20 was −2 $\mu$C/g.

Comparative Example 21 (As Uncrosslinked Core, Uncrosslinked Involved Capsule)

Wax Dispersion 21

The same wax dispersion as wax dispersion 7 was used.

Primary Polymer Particle Dispersion 21

Into a reactor (volume 60 liter, inner diameter 400 mm) equipped with an agitator (three blades), a concentrating apparatus, a jacket through which thermostat-regulated water flows, and an apparatus for charging starting materials and auxiliaries were charged 5 parts of 15% aqueous solution of NEOGEN SC and 372 parts of desalted water, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Trichlorobromomethane | 0.5 part |
| 2-mercaptoethanol | 0.01 part |
| [Aqueous solution of emulsifier] | |
| 15% aqueous solution of NEOGEN SC | 2.5 parts |
| Desalted water | 24 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 70,000, the average particle diameter determined by UPA was 203 nm and Tg was 71° C.

Particulate Resin Dispersion 21

Into a reactor (volume 3 liter, inner diameter 150 mm) equipped with an agitator (three backward blades), a concentrating apparatus, a jacket through which thermostat-regulated water flows, and an apparatus for charging starting materials and auxiliaries were charged wax dispersion 35 parts and desalted water 393 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| Trichlorobromomethane | 0.45 part |
| 2-mercaptoethanol | 0.01 part |
| [Aqueous solution of emulsifier] | |
| 15% aqueous solution of NEOGEN SC | 1 parts |
| Desalted water | 25 parts |
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 62,000, the average particle diameter determined by UPA was 213 nm and Tg was 53° C.

Particulate Colorant Dispersion 21

The same particulate colorant dispersion as particulate colorant dispersion 1 was used.

Particulate Charge Control Agent Dispersion 21

The same particulate charge control agent dispersion as particulate charge control agent dispersion 1 was used.

| Production of toner for development 21 | |
|---|---|
| Primary polymer particle dispersion 21 | 100 parts (as solid content) |
| Particulate resin dispersion 21 | 11 parts (as solid content) |
| Particulate colorant dispersion 1 | 6.7 parts (as solid content) |
| Particulate charge control agent dispersion 1 | 2 parts (as solid content) |
| Aqueous solution of 15% NEOGEN | 0.5 part (as solid content) |

By using the above-described respective components, toner was produced according to the following manner.

To a reactor (volume 1 liter, an anchor blade equipped with a baffle) were charged primary polymer particle dispersion and 15% aqueous solution of NEOGEN SC, which were uniformly mixed. Then particulate colorant dispersion was added to the resulting mixture, which were also uniformly mixed. Aqueous aluminum sulfate (0.6 part as solid content) was dropwise added to the mixture dispersion thus obtained with stirring. Thereafter, with stirring, the mixed dispersion obtained was heated to 55° C., which took 30 minutes, and the mixed dispersion was kept at that temperature for 1 hour, further heated to 60° C. for 2.5 hours, where it was kept for 30 minutes. Thereafter, the mixture obtained was cooled to 60° C. Then, particulate charge control agent dispersion, particulate resin dispersion and aqueous aluminum sulfate (0.1% as solid content) were successively added, which were kept for 10 minutes. Further, 15% aqueous solution of NEOGEN SC (3 parts as solid content) was added thereto. The resulting mixture was heated to 95° C. for 30 minutes where the mixture was kept for 2 hours. Successively, the mixture obtained was cooled, filtered, washed with water, and then dried to obtain a toner (toner 21).

To 100 parts of the toner thus obtained was mixed 0.6 part of silica having been subjected to hydrophobic surface treatment with stirring to obtain a toner for development (toner for development 21).

Evaluation of Toner 21

Toner for development 21 obtained had a volume average particle diameter determined by COULTER COUNTER of 6.9 $\mu$m. In the resulting toner, the portion having a volume particle diameter of 5 $\mu$m or less was 3.4%. While the portion having a volume particle diameter of 15 $\mu$m or more was 0.5%. The ratio of the volume average particle diameter and the number average particle diameter was 1.12. 50% circular degree of the toner was 0.97.

The fixability of toner for development 21 was evaluated. As the result, at both of a fixing rate of 120 mm/s and 30 mm/s, offset was caused.

The charged amount of toner 21 was −1 $\mu$C/g and the charged amount of toner for development 21 was −11 $\mu$C/g.

Example 22

Wax Dispersion 22

The same wax dispersion as wax dispersion 7 was used.

Primary Polymer Particle Dispersion 22

Into a reactor (volume 2 liter, inner diameter 120 mm) equipped with an agitator (three blades), a concentrating apparatus, a jacket through which thermostat-regulated water flows, and an apparatus for charging starting materials and auxiliaries were charged 35 parts of wax dispersion, 0.5 part of 15% aqueous solution of NEOGEN SC and 372 parts of desalted water, which were then heated to a temperature of 90° C. in a flow of nitrogen. Successively, 2% aqueous hydrogen peroxide 3.2 parts and 2% aqueous ascorbic acid 3.2 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 79 parts |
| Butyl acrylate | 21 parts |
| Acrylic acid | 3 parts |
| [Aqueous solution of emulsifier] | |
| 15% aqueous solution of NEOGEN SC | 2.7 parts |
| 1% Polyoxyethylenenonylphenyl ether | 1.1 parts |
| Desalted water | 22 parts |
| [Aqueous polymerization initiator] | |
| 2% aqueous hydrogen peroxide | 18 parts |
| 2% aqueous ascorbic acid | 18 parts |

After the completion of the polymerization reaction, the resulting product was cooled to obtain an opaque white polymer dispersion. The weight average molecular weight of the soluble matter in THF of the polymer was 359,000, the average particle diameter determined by UPA was 266 nm and Tg was 58° C. The solid concentration of the polymer was 17.9%.

Next, into a reactor (volume 2 liter, inner diameter 120 mm) equipped with an agitator (three blades), a heating condenser, a concentrating apparatus and an apparatus for charging starting materials and auxiliaries were charged the resulting high-molecular polymer dispersion 150 parts (as solid content), 15% aqueous NEOGEN SC 0.5 part and desalted water 372 parts, which were then heated to a temperature of 90° C. in a flow of nitrogen. Successively, 8% aqueous hydrogen peroxide 1.6 parts and 8% aqueous ascorbic acid 1.6 parts were added thereto.

Thereafter, to the mixture obtained a mixture of the following monomers and aqueous solution of emulsifier was added for 5 hours from the initiation of polymerization and aqueous polymerization initiator was added for 6 hours from the initiation of polymerization. The resulting reaction mixture was further kept for 30 minutes.

| | |
|---|---|
| [Monomers] | |
| Styrene | 92 parts |
| Butyl acrylate | 8 parts |
| Acrylic acid | 3 parts |
| Trichlorobromomethane | 4 parts |
| 2-mercaptoethanol | 0.04 part |
| [Aqueous solution of emulsifier] | |
| 15% aqueous solution of NEOGEN SC | 5.3 parts |
| 10% polyoxyethylenenonylphenyl ether | 1 part |
| Desalted water | 15 parts |

-continued

| | |
|---|---|
| [Aqueous polymerization initiator] | |
| 8% aqueous hydrogen peroxide | 9 parts |
| 8% aqueous ascorbic acid | 9 parts |

After the completion of the polymerization reaction, the resulting product was cooled to obtain an opaque white polymer dispersion. The weight average molecular weight of the soluble matter in THF of the polymer was 287,000, the average particle diameter determined by UPA was 252 nm and Tg was 58° C.

Particulate Colorant Dispersion 22

The same particulate colorant dispersion as particulate colorant dispersion 1 was used.

Particulate Charge Control Agent Dispersion 22

The same particulate charge control agent dispersion as particulate charge control agent dispersion 1 was used.

| Production of toner for development 22 | |
|---|---|
| Primary polymer particle dispersion 22 | 100 parts (as solid content) |
| Particulate colorant dispersion 1 | 6.7 parts (as solid content) |
| Particulate charge control agent dispersion 1 | 2 parts (as solid content) |

By using the above-described respective components, toner was produced according to the following manner.

To a reactor (volume 1 liter, an anchor blade equipped with a baffle) were charged primary polymer particle dispersion and particulate colorant dispersion, which were uniformly mixed. Aqueous aluminum sulfate (0.3 part as solid content) was dropwise added to the mixture dispersion thus obtained with stirring. Thereafter, stirring was effected at 25° C. for 30 minutes. Then, the mixed dispersion obtained was heated to 60° C., where it was kept for 30 minutes. Further particulate charge control agent dispersion was added thereto, which were kept for 20 minutes. Thereafter, the mixture obtained was heated to 63° C. Next, 5% triethanolamine was dropwise added to control the pH of the mixture to 6.3. Successively, the mixture was heated to 95° C. for 2 hours, where it was kept for 4 hours. Then, the mixture obtained was cooled, filtered, washed with water, and then dried to obtain a toner (toner 22).

To 100 parts of the toner thus obtained was mixed 0.6 part of silica having been subjected to hydrophobic surface treatment with stirring to obtain a toner for development (toner for development 22).

Evaluation of Toner 22

The toner for development 22 obtained had a volume average particle diameter determined by COULTER COUNTER of 6.3 μm. In the resulting toner, the portion having a volume particle diameter of 5 μm or less was 13.5%. While the portion having a volume particle diameter of 15 μm or more was 0.4%. The ratio of the volume average particle diameter and the number average particle diameter was 1.15. 50% circular degree of the toner was 0.93.

The fixability of toner for development 22 was evaluated. As the result, at a fixing rate of 120 mm/s and Nip of 4 mm, the toner was fixed at a temperature of from 150° C. to 220° C., and at a fixing rate of 120 mm/s and Nip 31 mm, the toner was fixed at a temperature of from 110° C. to 220° C. The OHP transparency of the toner was as low as 30%.

The charged amount of toner 22 was −1 μC/g and the charged amount of toner for development 22 was −11 μC/g.

The present application is based on Japanese Patent Applications JP H11-355371, JP H12-61698, JP H12-61699 and JP H12-182606, filed in the Japanese Patent Office on Dec. 15, 1999, Mar. 7, 2000, Mar. 7, 2000 and Jun. 19, 2000, respectively, the entire contents of which are hereby incorporated by reference.

| | | Wax | | Primary polymer particle | | | | | Particulate resin | | |
|---|---|---|---|---|---|---|---|---|---|---|---|
| | Pigment Kind | Kind and mp. | Particle size nm LA500 | Molecular weight Mw | Molecular weight peak Mp | Crosslinking degree (THF insoluble content) | Primary polymer particle diameter nm UPA | Molecular weight Mw | Molecular weight peak Mp | Crosslinking degree (THF insoluble content) | Particulate resin diameter nm UPA |
| Ex. 1 | Pigment blue 15:3 | *UNISTER M2222Sl/ UNISTER M9676 (70/30) 70° C./65° C. | 340 | 119,000 | 47,500 | 52 | 189 | 54,000 | 47,000 | 15 | 83 |
| Ex. 2 | Pigment yellow 74 | *UNISTER M2222Sl/ UNISTER M9676 (70/30) 70° C./65° C. | " | 148,000 | 55,500 | 60 | 207 | " | " | " | " |
| Ex. 3 | Pigment red 238 | *UNISTER M2222Sl/ UNISTER M9676 (70/30) 70° C./65° C. | " | 119,000 | 47,500 | 52 | 189 | " | " | " | " |
| Ex. 4 | Pigment red 238 | *UNISTER M2222Sl/ UNISTER M9676 (70/30) 70° C./65° C. | 330 | 152,000 | 53,700 | 60 | 200 | | | | |
| Ex. 5 | Pigment blue 15:3 | UNISTER H476 65° C. | 350 | 139,000 | 56,000 | 53 | 201 | 57,000 | 49,600 | 10 | 56 |
| Ex. 6 | Pigment blue 15:3 | UNISTER M2222Sl/ Polyester wax (70/30) 70° C./70° C. | 490 | 117,000 | 53,000 | 41 | 201 | " | " | " | " |
| Ex. 7 | Pigment red 48:2 | UNISTER M2222SL 70° C. | 340 | 127,000 | 49,000 | 38 | 201 | 111,000 | 58,400 | 20 | 121 |
| Ex. 8 | Pigment red 48:2 | UNISTER M2222SL 70° C. | " | " | " | " | " | | | | |
| Ex. 9 | Pigment blue 15:3 | UNISTER M2222SL 70° C. | " | 98,000 | 41,200 | 25 | 188 | 111,000 | 58,400 | 20 | 121 |
| Ex. 10 | Pigment red 238 | UNISTER M2222SL 70° C. | " | " | " | " | " | " | " | " | " |
| Comp. Ex. 11 | Pigment blue 15:3 | None | | 126,000 | 56,700 | 30 | 199 | 54,000 | 47,000 | 15 | 83 |
| Ex. 12 | Pigment blue 15:3 | *UNISTER M2222Sl/ UNISTER M9676 (70/30) 70° C./65° C. | 340 | 62,000 | 55,400 | 0 | 213 | " | " | " | " |
| Ex. 13 | Pigment blue 15:3 | Glycerice montanate 81° C. | 900 | 160,000 | 53,000 | 35 | 280 | — | — | — | — |
| Ex. 14 | Pigment blue 15:3 | Glyceride montanate/ behenyl behenate (50/50) 81° C./70° C. | 900 | 160,000 | 54,000 | 35 | 280 | — | — | — | — |

-continued

| | | Wax | | Primary polymer particle | | | | | Particulate resin | | |
|---|---|---|---|---|---|---|---|---|---|---|---|
| | Pigment Kind | Kind and mp. | Particle size nm LA500 | Molecular weight Mw | Molecular weight peak Mp | Crosslinking degree (THF insoluble content) | Primary polymer particle diameter nm UPA | Molecular weight Mw | Molecular weight peak Mp | Crosslinking degree (THF insoluble content) | Particulate resin diameter nm UPA |
| Ex. 15 | Pigment blue 15:3 | Glyceride M222SL 70° C. | 340 | 98,000 | 41,200 | 40 | 190 | 60,000 | 49,000 | 0 | 154 |
| Ex. 16 | Pigment blue 15:3 | UNISTER M2222SL 70° C. | 340 | 45,000 | 40,000 | 0 | 200 | 98,000 | 42,000 | 15 | 150 |
| Ex. 17 | Pigment blue 15:3 | Glyceride montanate/ behenyl behenate (50/50) 81° C./70° C. | 700 | 160,000 | 53,000 | 45 | 280 | — | — | — | — |
| Ex. 18 | Pigment blue 15:3 | UNISTER M2222SL 70° C. | 900 | 243,000 | 52,900 | 30 | 263 | — | — | — | — |
| Ex.19 | Pigment blue 15:3 | UNISTER H476 65° C. | 350 | 104,000 | 60,400 | 60 | 207 | — | — | — | — |
| Comp. Ex. 20 | Pigment blue 15:3 | UNISTER M2222SL 70° C. | 340 | 72,700 | 52,400 | 0 | 202 | — | — | — | — |
| Comp. Ex. 21 | Pigment blue 15:3 | UNISTER M2222SL 70° C. | " | 70,000 | 52,000 | 0 | 203 | 62,000 | 55,400 | 0 | 213 |
| Comp. Ex. 22 | Pigment blue 15:3 | UNISTER M2222SL 70° C. | " | 287,000 | 9,000 125,000 | 10 | 250 | — | — | — | — |

| | Toner | | | | | | | |
|---|---|---|---|---|---|---|---|---|
| | THF insoluble content % | | | | | Ratio of volume | Electrification μC/g | |
| | Of toner | Of binder resin in toner | Particle diameter (volume) μm | <5 μm (volume) % | >15 μm (volume) % | particle diameter/ number average particle diameter | Non-external addition | External addition |
| Example 1 | 33 | 27 | 7.2 | 3.5 | 0.5 | 1.12 | −7 | −15 |
| Example 2 | 55 | 49 | 7.5 | 1.6 | 0.7 | 1.14 | −4 | −3 |
| Example 3 | 48 | 42 | 7.8 | 2.1 | 2.1 | 1.15 | −17 | −17 |
| Example 4 | 60 | 54 | 8.2 | 1.1 | 1.8 | 1.15 | −20 | −25 |
| Example 5 | 40 | 34 | 7.9 | 2.0 | 3.6 | 1.2 | −9 | −15 |
| Example 6 | 38 | 32 | 8.2 | 0.7 | 1.6 | 1.14 | −35 | −21 |
| Example 7 | 35 | 29 | 7.8 | 1.3 | 2.8 | 1.15 | −15 | −28 |
| Example 8 | 35 | 29 | 7.3 | 3.1 | 0.5 | 1.14 | −3 | −14 |
| Example 9 | 30 | 24 | 7.3 | 1.4 | 0.3 | 1.11 | −8 | −14 |
| Example 10 | 30 | 24 | 7.6 | 1.6 | 2.4 | 1.15 | −20 | −25 |
| Comp. Ex. 11 | 65 | 59 | 7.5 | 1.1 | 2.5 | 1.14 | −27 | −58 |
| Example 12 | 15 | 9 | 9.8 | 0.3 | 3.3 | 1.17 | −19 | −12 |
| Example 13 | 34 | 28 | 8.8 | 0.2 | 0.3 | 1.11 | −3 | −15 |
| Example 14 | 35 | 29 | 8.8 | 0.2 | 0.5 | 1.11 | −5 | −17 |
| Example 15 | 35 | 29 | 7.4 | 1.7 | 0.3 | 1.09 | −18 | −18 |
| Example 16 | 15 | 9 | 7.5 | 1.6 | 0.2 | 1.1 | −10 | −20 |
| Example 17 | 40 | 34 | 7.8 | 1.5 | 0.5 | 1.17 | −3 | −11 |
| Example 18 | 31 | 25 | 7.4 | 7.2 | 4.6 | 1.12 | −10 | −14 |
| Example 19 | 62 | 56 | 6.6 | 9.0 | 4.4 | 1.24 | −8 | −14 |
| Comp. Ex. 20 | 10 | 4 | 8.5 | 5.4 | 14.5 | 1.42 | 2 | −2 |
| Comp. Ex. 21 | 10 | 4 | 6.9 | 3.4 | 0.5 | 1.12 | −1 | −11 |
| Ex. 22 | 13 | 7 | 6.3 | 13.5 | 0.43 | 1.15 | −1 | −2 |

What is claimed is:

1. A toner, comprising:

an agglomerate of particles obtained by agglomerating a mixture comprising primary polymer particles and primary colorant particles;

wherein the toner has a THF insoluble content of from 15% to 80% by weight;

wherein the toner comprises a wax having a melting point of 30 to 100° C.;

wherein a THF insoluble content of the primary polymer particles is from 15% to 70% by weight;

wherein the primary polymer particles comprise units obtained from 0.5 to 5% by weight of acrylic acid or methacrylic acid, based on a total amount of said primary polymer particles.

2. The toner as claimed in claim 1, wherein the THF insoluble content of the toner is from 20% to 70% by weight.

3. The toner as claimed in claim 1, wherein the primary polymer particles comprise units obtained from a monomer containing either a Brönsted acidic group or a Brönsted basic group.

4. The toner as claimed in claim 1, wherein the wax has a melting point of 40 to 90° C.

5. The toner as claimed in claim 1, wherein the wax is contained in the toner in an amount of from 1 to 40 parts by weight based on 100 parts by weight of a binder resin in the toner.

6. The toner as claimed in claim 1, wherein the wax comprises an aliphatic alcohol ester of an aliphatic carboxylic acid having 20 to 100 carbon atoms.

7. The toner as claimed in claim 6, wherein the wax comprises three or more different wax compounds.

8. The toner as claimed in claim 7, wherein at least two of the three or more wax compounds are aliphatic alcohol esters of an aliphatic carboxylic acid having 20 to 100 carbon atoms.

9. The toner as claimed in claim 1, wherein the wax comprises an aliphatic carboxylic acid ester or an aliphatic carboxylic acid partial ester of a polyhydric alcohol.

10. The toner as claimed in claim 9, wherein the polyhydric alcohol is pentaerythritol.

11. The toner as claimed in claim 1, wherein the primary polymer particles are obtained by emulsion polymerization with a particulate wax as a seed.

12. The toner as claimed in claim 11, wherein the particulate wax has an average volume particle diameter of from 0.01 to 3 μm.

13. The toner as claimed in claim 1, wherein the agglomerate of particles obtained by agglomerating at least primary polymer particles and primary colorant particles is at least substantially coated with a particulate resin.

14. The toner as claimed in claim 13, wherein the toner is a negatively charged toner.

15. The toner as claimed in claim 13, wherein the particulate resin has a THF insoluble content of from 5% to 70% by weight.

16. The toner as claimed in claim 17, wherein the primary polymer particles comprise a polyfunctional monomer in an amount of from 0.005 to 5% by weight and the particulate resin comprises a polyfunctional monomer in an amount of from 0.005 to 5% by weight.

17. The toner as claimed in claim 13, wherein the particulate resin is substantially free from wax.

18. The toner as claimed in claim 1, wherein the primary colorant particles comprise a colorant compound represented by the following formula (I):

(I)

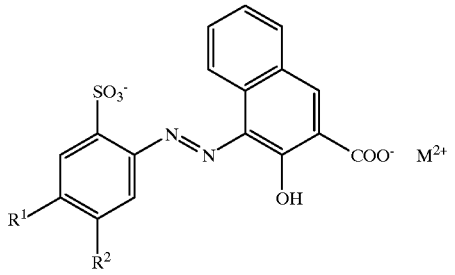

wherein $R^1$ and $R^2$ each independently represents a hydrogen atom, an alkyl group or a halogen atom, provided that at least one of $R^1$ and $R^2$ is a halogen atom, and M represents Ba, Sr, Mn, Ca or Mg.

19. The toner as claimed in claim 1, wherein the primary colorant particles comprise a colorant compound represented by the following formula (II):

(II)

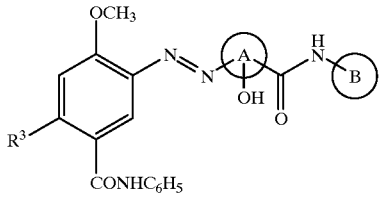

wherein A and B each, independently, represents an aromatic ring which can be substituted, and $R^3$ represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

20. The toner as claimed in claim 1, wherein the toner has a ratio of volume-average particle diameter and number-average particle diameter (volume-average particle diameter/number-average particle diameter) of from 1 to 1.25.

21. The toner as claimed in claim 1, wherein the toner has a 50% circular degree of from 0.95 to 1.

22. The toner as claimed in claim 1, wherein the toner has a volume-average particle diameter of from 7 to 10 μm, and 10% by volume or less of the toner has a particle diameter of 5 μm or less.

23. The toner as claimed in claim 1, wherein the toner has a volume-average particle diameter of from 7 to 10 μm, and 5% by volume or less of the toner has a particle diameter of 15 μm or more.

24. The toner as claimed in claim 1, wherein the primary polymer particles have a THF-soluble component having a weight-average molecular weight of from 30,000 to 500,000.

25. A toner, comprising:

an agglomerate of particles obtained by agglomerating a mixture comprising primary polymer particles and primary colorant particles;

wherein said primary polymer particles comprise units obtained from one or more monomers and a polyfunctional monomer;

wherein said polyfunctional monomer is present in an amount of from 0.005 to 5% by weight;

wherein the toner comprises wax having a melting point of 30 to 100° C.;

wherein a THF insoluble content of the primary polymer particles is from 15% to 70% by weight;

wherein the primary polymer particles comprise units obtained from 0.5 to 5% by weight of acrylic acid or methacrylic acid, based on a total amount of said primary polymer particles.

26. The toner as claimed in claim 25, wherein a THF insoluble content of the toner is from 20% to 70% by weight.

27. The toner as claimed in claim 25, wherein the wax is contained in the toner in an amount of from 1 to 40 parts by weight based on 100 parts by weight of a binder resin in the toner.

28. The toner as claimed in claim 25, wherein the wax comprises a) an aliphatic alcohol ester of an aliphatic carboxylic acid having 20 to 100 carbon atoms or b) an aliphatic carboxylic acid ester or an aliphatic carboxylic acid partial ester of a polyhydric alcohol.

29. The toner as claimed in claim 28, wherein the wax comprises three or more different wax compounds.

30. The toner as claimed in claim 28, wherein the polyhydric alcohol is pentaerythritol.

31. The toner as claimed in claim 25, wherein the primary polymer particles are obtained by emulsion polymerization with a particulate wax as a seed.

32. The toner as claimed in claim 31, wherein the particulate wax has an average volume particle diameter of from 0.01 to 3 /μm.

33. The toner as claimed in claim 25, wherein the agglomerate of particles obtained by agglomerating at least primary polymer particles and primary colorant particles is at least substantially coated with a particulate resin.

34. The toner as claimed in claim 33, wherein the toner is a negatively charged toner.

35. The toner as claimed in claim 33, wherein the particulate resin has a THF insoluble content of from 5% to 70% by weight.

36. The toner as claimed in claim 33, wherein the particulate resin comprises a polyfunctional monomer in an amount of from 0.005 to 5% by weight.

37. The toner as claimed in claim 33, wherein the particulate resin is substantially free from wax.

38. The toner as claimed in claim 25, wherein the primary colorant particles comprise a colorant compound represented by the following formula (I):

(I)

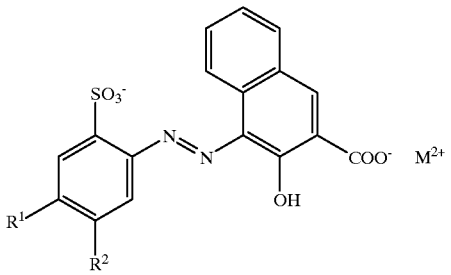

wherein $R^1$ and $R^2$ each independently represents a hydrogen atom, an alkyl group or a halogen atom, provided that at least one of $R^1$ and $R^2$ is a halogen atom, and M represents Ba, Sr, Mn, Ca or Mg.

39. The toner as claimed in claim 25, wherein the primary colorant particles comprise a colorant compound represented by the following formula (II):

(II)

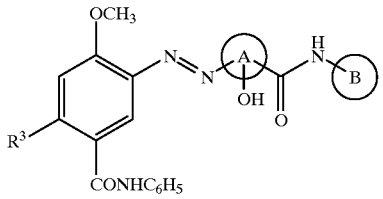

wherein A and B each, independently, represents an aromatic ring which can be substituted, and $R^3$ represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

40. The toner as claimed in claim 25, wherein the toner has a ratio of volume-average particle diameter and number-average particle diameter (volume-average particle diameter/number-average particle diameter) of from 1 to 1.25.

41. The toner as claimed in claim 25, wherein the toner has a 50% circular degree of from 0.95 to 1.

42. The toner as claimed in claim 25, wherein the toner has a volume-average particle diameter of from 7 to 10 μm, and 10% by volume or less of the toner has a particle diameter of 5 μm or less.

43. The toner as claimed in claim 25, wherein the toner has a volume-average particle diameter of from 7 to 10 μm, and 5% by volume or less of the toner has a particle diameter of 15 μm or more.

44. The toner as claimed in claim 25, wherein the primary polymer particles have a THF-soluble component having a weight-average molecular weight of from 30,000 to 500,000.

45. A method for producing a toner, comprising:

agglomerating at least primary polymer particles and primary colorant particles to form an agglomerate of particles;

aging the agglomerate of particles at a temperature equal to or greater than Tg of the primary polymer particles; and coating at least a substantial portion of the surface of the agglomerate of particles with a particulate resin;

wherein the primary polymer particles are produced by emulsion polymerization of a monomer mixture comprising 0.005 to 5% by weight of a polyfunctional monomer, and the toner comprises wax having a melting point of 30 to 100° C.

46. The method of claim 45, wherein said coating of the agglomerate of particles with the particulate resin is performed between said agglomerating and aging steps.

47. The method of claim 46, wherein said particulate resin is substantially free from wax and wherein said aging step is performed at a temperature range of from a glass transition temperature of a binder resin constituting the agglomerate of particles (Tg) to Tg +80° C.

48. The method of claim 45, wherein said coating of the agglomerate of particles with the particulate resin is performed after said aging step.

49. The method of claim 48, further comprising a second aging step following said coating step.

50. The method of claim 45, further comprising coating at least a substantial portion of the surface of said agglomerate of particles with a particulate charge control agent.

51. The method of claim 50, wherein said particulate resin and said particulate charge control agent are both coated between said agglomerating step and said aging step.

52. The method of claim 50, wherein said particulate resin is coated between said agglomerating step and said aging step and said charge control agent is coated after said aging step.

53. The method of claim 52, further comprising a second aging step following said coating of said charge control agent.

54. The method of claim 50, wherein said charge control agent is coated between said agglomerating step and said aging step and said particulate resin is coated after said aging step.

55. The method of claim 54, further comprising a second aging step following said coating of said particulate resin.

56. The method of claim 50, wherein both of said particulate resin and said charge control agent are coated after said aging step.

57. The method of claim 56, further comprising a second aging step following said coating of both of said particulate resin and said charge control agent.

58. The method of claim 45, wherein the particulate resin is produced by emulsion polymerization of a monomer mixture comprising 0.005 to 5% by weight of a polyfunctional monomer.

59. The method of claim 45, wherein the particulate resin has a volume-average particle diameter of from 0.02 to 3 μm.

60. The method of claim 45, wherein the particulate resin is substantially free of wax.

61. The method of claim 45, wherein the primary polymer particles are produced by emulsion polymerization of a monomer mixture comprising 0.5 to 5% by weight of a monomer having a Brönsted acidic group or a Brönsted basic group.

62. A method for producing a toner comprising agglomerating a mixture of at least primary polymer particles and primary colorant particles to form an agglomerate of particles, and coating at least a substantial portion of the surface of said agglomerate of particles with a particulate resin, wherein the primary polymer particles are produced by seed emulsion polymerization of a monomer mixture substantially free of a polyfunctional monomer, in the presence of a particulate wax having a melting point of 30 to 100° C., and the particulate resin is obtained by emulsion polymerization of a monomer mixture comprising 0.005 to 5% by weight of a polyfunctional monomer.

63. A toner, comprising:

an agglomerate of particles obtained by agglomerating a mixture comprising primary polymer particles and primary colorant particles;

wherein the toner has a THF insoluble content of from 20% to 70% by weight;

wherein the toner comprises a wax having a melting point of 30 to 100° C.;

wherein the primary polymer particles comprise units obtained from 0.5 to 5% by weight of acrylic acid or methacrylic acid, based on a total amount of said primary polymer particles.

64. The toner as claimed in claim 63, wherein the wax is contained in the toner in an amount of from 1 to 40 parts by weight based on 100 parts by weight of a binder resin in the toner.

65. The toner as claimed in claim 63, wherein the wax comprises a) an aliphatic alcohol ester of an aliphatic carboxylic acid having 20 to 100 carbon atoms or b) an aliphatic carboxylic acid ester or an aliphatic carboxylic acid partial ester of a polyhydric alcohol.

66. The toner as claimed in claim 65, wherein the wax comprises three or more different wax compounds.

67. The toner as claimed in claim 66, wherein at least two of the three or more wax compounds are aliphatic alcohol esters of an aliphatic carboxylic acid having 20 to 100 carbon atoms.

68. The toner as claimed in claim 65, wherein the polyhydric alcohol is pentaerythritol.

69. The toner as claimed in claim 63, wherein the primary polymer particles are obtained by emulsion polymerization with a particulate wax as a seed.

70. The toner as claimed in claim 69, wherein the particulate wax has an average volume particle diameter of from 0.01 to 3 μm.

71. The toner as claimed in claim 63, wherein the agglomerate of particles obtained by agglomerating at least primary polymer particles and primary colorant particles is at least substantially coated with a particulate resin.

72. The toner as claimed in claim 71, wherein the toner is a negatively charged toner.

73. The toner as claimed in claim 71, wherein the particulate resin has a THF insoluble content of from 5% to 70% by weight.

74. The toner as claimed in claim 71, wherein the primary polymer particles comprise a polyfunctional monomer in an amount of from 0.005 to 5% by weight and the particulate resin comprises a polyfunctional monomer in an amount of from 0.005 to 5% by weight.

75. The toner as claimed in claim 71, wherein the particulate resin is substantially free from wax.

76. The toner as claimed in claim 63, wherein the primary colorant particles comprise a colorant compound represented by the following formula (I):

(I)

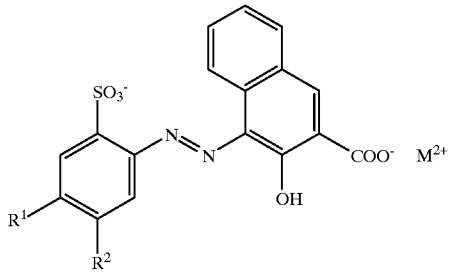

wherein $R^1$ and $R^2$ each independently represents a hydrogen atom, an alkyl group or a halogen atom, provided that at least one of $R^1$ and $R^2$ is a halogen atom, and M represents Ba, Sr, Mn, Ca or Mg.

77. The toner as claimed in claim 63, wherein the primary colorant particles comprise a colorant compound represented by the following formula (II):

(II)

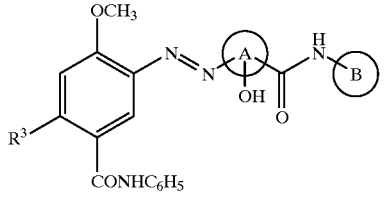

wherein A and B each, independently, represents an aromatic ring which can be substituted, and $R^3$ represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

78. The toner as claimed in claim 63, wherein the toner has a ratio of volume-average particle diameter and number-average particle diameter (volume-average particle diameter/number-average particle diameter) of from 1 to 1.25.

79. The toner as claimed in claim 63, wherein the toner has a 50% circular degree of from 0.95 to 1.

80. The toner as claimed in claim 63, wherein the toner has a volume-average particle diameter of from 7 to 10 $\mu$m, and 10% by volume or less of the toner has a particle diameter of 5 $\mu$m or less.

81. The toner as claimed in claim 63, wherein the toner has a volume-average particle diameter of from 7 to 10 $\mu$m, and 5% by volume or less of the toner has a particle diameter of 15 $\mu$m or more.

82. The toner as claimed in claim 63, wherein the primary polymer particles have a THF-soluble component having a weight-average molecular weight of from 30,000 to 500,000.

83. A toner, comprising:

an agglomerate of particles obtained by agglomerating a mixture comprising primary polymer particles and primary colorant particles;

wherein the toner has a THF insoluble content of from 15% to 80% by weight;

wherein the toner comprises a wax having a melting point of 30 to 100° C.;

wherein the toner has a ratio of volume-average particle diameter and number-average particle diameter (volume-average particle diameter/number-average particle diameter) of from 1 to 1.25;

wherein the toner has a volume-average particle diameter of from 7 to 10 $\mu$m, and 10% b volume or less of the toner has a particle diameter of 5 $\mu$m or less.

84. The toner according to claim 83, wherein a THF insoluble content of the primary polymer particles is from 15% to 70% by weight.

85. The toner as claimed in claim 83, wherein the primary polymer particles comprise units obtained from a monomer containing either a Brönsted acidic group or a Brönsted basic group.

86. The toner as claimed in claim 83, wherein the wax is contained in the toner in an amount of from 1 to 40 parts by weight based on 100 parts by weight of a binder resin in the toner.

87. The toner as claimed in claim 83, wherein the wax comprises a) an aliphatic alcohol ester of an aliphatic carboxylic acid having 20 to 100 carbon atoms or b) an aliphatic carboxylic acid ester or an aliphatic carboxylic acid partial ester of a polyhydric alcohol.

88. The toner as claimed in claim 87, wherein the wax comprises three or more different wax compounds.

89. The toner as claimed in claim 88, wherein at least two of the three or more wax compounds are aliphatic alcohol esters of an aliphatic carboxylic acid having 20 to 100 carbon atoms.

90. The toner as claimed in claim 87, wherein the polyhydric alcohol is pentaerythritol.

91. The toner as claimed in claim 83, wherein the primary polymer particles are obtained by emulsion polymerization with a particulate wax as a seed.

92. The toner as claimed in claim 91, wherein the particulate wax has an average volume particle diameter of from 0.01 to 3 $\mu$m.

93. The toner as claimed in claim 83, wherein the agglomerate of particles obtained by agglomerating at least primary polymer particles and primary colorant particles is at least substantially coated with a particulate resin.

94. The toner as claimed in claim 93, wherein the toner is a negatively charged toner.

95. The toner as claimed in claim 93, wherein the particulate resin has a THF insoluble content of from 5% to 70% by weight.

96. The toner as claimed in claim 93, wherein the primary polymer particles comprise a polyfunctional monomer in an amount of from 0.005 to 5% by weight and the particulate resin comprises a polyfunctional monomer in an amount of from 0.005 to 5% by weight.

97. The toner as claimed in claim 93, wherein the particulate resin is substantially free from wax.

98. The toner as claimed in claim 83, wherein the primary colorant particles comprise a colorant compound represented by the following formula (I):

(I)

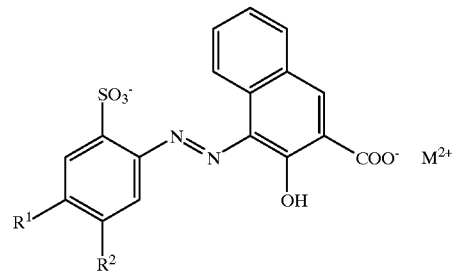

wherein $R^1$ and $R^2$ each independently represents a hydrogen atom, an alkyl group or a halogen atom, provided that at least one of $R^1$ and $R^2$ is a halogen atom, and M represents Ba, Sr, Mn, Ca or Mg.

99. The toner as claimed in claim 83, wherein the primary colorant particles comprise a colorant compound represented by the following formula (II):

(II)

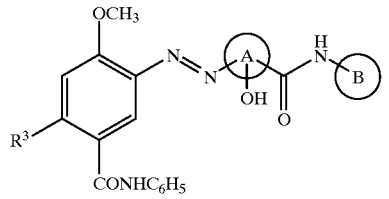

wherein A and B each, independently, represents an aromatic ring which can be substituted, and $R^3$ represents a hydrogen atom, a halogen atom, a nitro group, a cyano group, a hydrocarbon group having 1 to 5 carbon atoms, an alkoxy group having 1 to 5 carbon atoms, an aminosulfonyl group wherein the nitrogen atom may be substituted or an aminocarbonyl group wherein the nitrogen atom may be substituted.

100. The toner as claimed in claim 83, wherein the toner has a 50% circular degree of from 0.95 to 1.

101. The toner as claimed in claim 83, wherein 5% by volume or less of the toner has a particle diameter of 15 $\mu$m or more.

102. The toner as claimed in claim 83, wherein the primary polymer particles have a THF-soluble component having a weight-average molecular weight of from 30,000 to 500,000.

103. The toner as claimed in claim 83, wherein a THF-soluble component of said primary polymer particles has a molecular weight peak of from 30,000 to 150,000.

104. A method for producing a toner, comprising:

agglomerating at least primary polymer particles and primary colorant particles to form an agglomerate of particles; and coating at least a substantial portion of the surface of the agglomerate of particles with a particulate resin;

wherein the toner comprises wax having a melting point of 30 to 100° C.; and wherein the primary polymer particles are produced by seed emulsion polymerization of a monomer mixture comprising 0.005 to 5% by weight of a polyfunctional monomer in the presence of a particulate wax having a melting point of 30 to 100° C.

105. The method of claim 104, wherein said coating of the agglomerate of particles with the particulate resin is performed between said agglomerating and aging steps.

106. The method of claim 105, wherein said particulate resin is substantially free from wax and wherein said aging step is performed at a temperature range of from a glass transition temperature of a binder resin constituting the agglomerate of particles (Tg) to Tg +80° C.

107. The method of claim 104, wherein said coating of the agglomerate of particles with the particulate resin is performed after said aging step.

108. The method of claim 107, further comprising a second aging step following said coating step.

109. The method of claim 104, further comprising coating at least a substantial portion of the surface of said agglomerate of particles with a particulate charge control agent.

110. The method of claim 109, wherein said particulate resin and said particulate charge control agent are both coated between said agglomerating step and said aging step.

111. The method of claim 109, wherein said particulate resin is coated between said agglomerating step and said aging step and said charge control agent is coated after said aging step.

112. The method of claim 111, further comprising a second aging step following said coating of said charge control agent.

113. The method of claim 109, wherein said charge control agent is coated between said agglomerating step and said aging step and said particulate resin is coated after said aging step.

114. The method of claim 113, further comprising a second aging step following said coating of said particulate resin.

115. The method of claim 109, wherein both of said particulate resin and said charge control agent are coated after said aging step.

116. The method of claim 115, further comprising a second aging step following said coating of both of said particulate resin and said charge control agent.

117. The method of claim 109, wherein the particulate resin has a volume-average particle diameter of from 0.02 to 3 $\mu$m.

118. The method of claim 109, wherein the particulate resin is substantially free of wax.

119. The method of claim 104, wherein the particulate wax is produced by dispersing one or more wax compounds in water having a temperature higher than a melting temperature of the particulate wax, in the presence of an emulsifier.

* * * * *